US008391768B2

(12) United States Patent
Abe et al.

(10) Patent No.: US 8,391,768 B2
(45) Date of Patent: Mar. 5, 2013

(54) CONFIGURATION FOR CLEANING A PHOTOSENSITIVE UNIT AND A TANDEM PHOTOSENSITIVE UNIT

(75) Inventors: Koji Abe, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 427 days.

(21) Appl. No.: 12/748,005

(22) Filed: Mar. 26, 2010

(65) Prior Publication Data

US 2010/0278571 A1 Nov. 4, 2010

(30) Foreign Application Priority Data

May 1, 2009 (JP) ..... 2009-111857

(51) Int. Cl.
*G03G 21/00* (2006.01)

(52) U.S. Cl. ..... 399/357; 399/100

(58) Field of Classification Search ..... 399/357, 399/176, 100

See application file for complete search history.

(56) References Cited

U.S. PATENT DOCUMENTS

| | | | | |
|---|---|---|---|---|
| 4,974,030 | A * | 11/1990 | Tokunaga et al. | 399/347 |
| 6,928,252 | B2 * | 8/2005 | Takami et al. | 399/111 |
| 7,702,275 | B2 * | 4/2010 | Morishita | 399/357 |
| 2003/0185588 | A1 | 10/2003 | Takami et al. | |
| 2005/0031373 | A1 | 2/2005 | Ishii | |
| 2006/0067727 | A1 * | 3/2006 | Suda et al. | 399/100 |
| 2006/0115292 | A1 * | 6/2006 | Sampe et al. | 399/100 |
| 2007/0098435 | A1 * | 5/2007 | Kitagawa et al. | 399/100 |
| 2007/0177891 | A1 * | 8/2007 | Honobe et al. | 399/100 |
| 2009/0169258 | A1 | 7/2009 | Kamimura | |

FOREIGN PATENT DOCUMENTS

| | | | |
|---|---|---|---|
| JP | 11249364 | A * | 9/1999 |
| JP | 2003-295719 | | 10/2003 |
| JP | 2005-055771 | | 3/2005 |
| JP | 2006-023390 | | 1/2006 |
| JP | 2009-157310 | | 7/2009 |

* cited by examiner

*Primary Examiner* — David Gray
*Assistant Examiner* — G. M. Hyder
(74) *Attorney, Agent, or Firm* — Banner & Witcoff, Ltd.

(57) ABSTRACT

A photosensitive unit includes: a photosensitive member that carries a developer image on a surface thereof; a primary roller, which contacts the surface of the photosensitive member, and which captures a foreign substance on the surface of the photosensitive member; a pair of primary bearing members that rotatably support axial end portions of the primary roller; a pair of pressing members that press the pair of primary bearing members toward the photosensitive member; and a pair of guide members that guide the pair of primary bearing members in a pressing direction in which the pair of pressing members press the pair of primary bearing members.

23 Claims, 12 Drawing Sheets

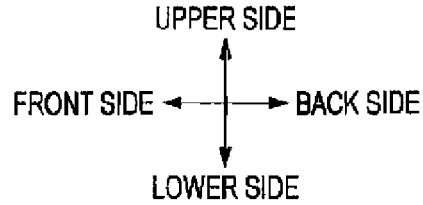
FIG. 9A
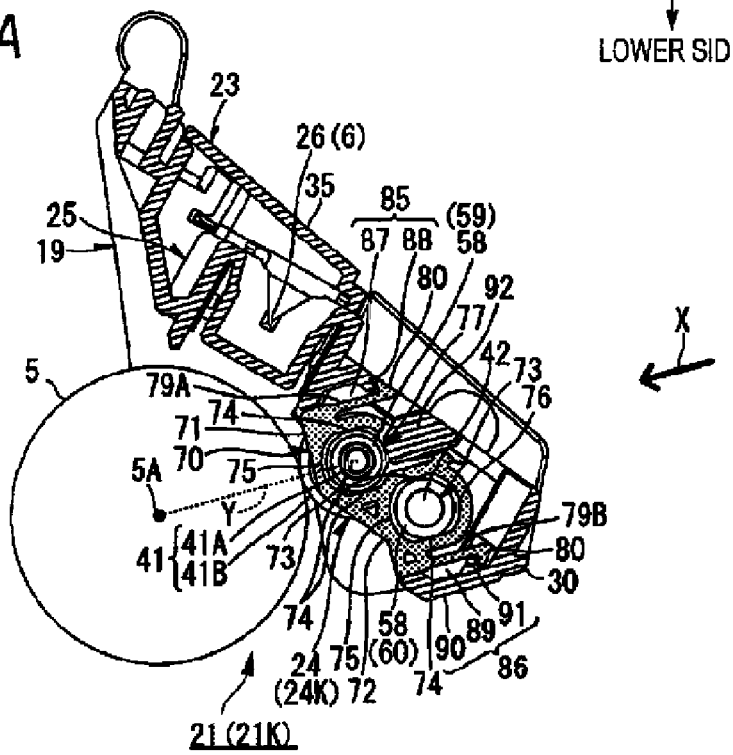
FIG. 9B
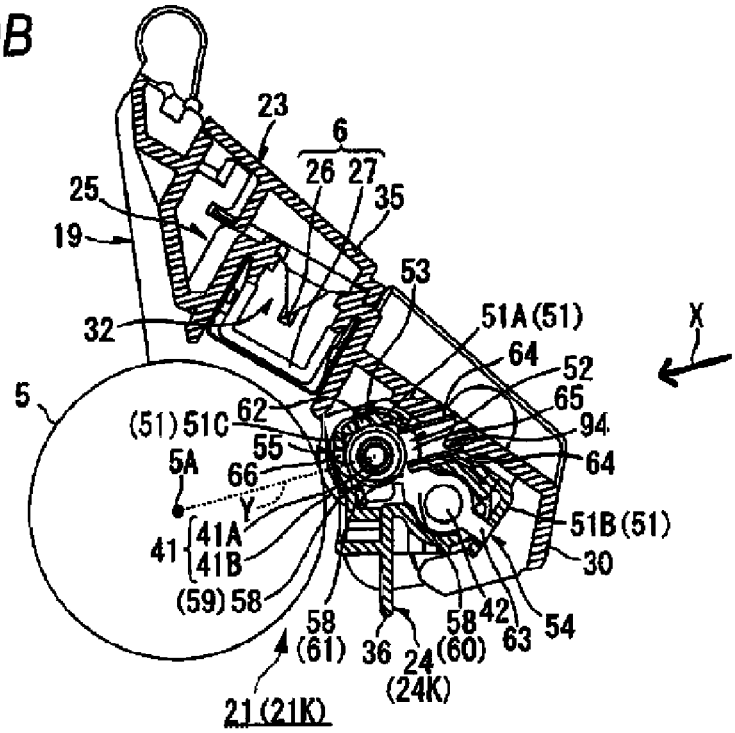

CONFIGURATION FOR CLEANING A PHOTOSENSITIVE UNIT AND A TANDEM PHOTOSENSITIVE UNIT

CROSS-REFERENCE TO RELATED APPLICATIONS

This application claims priority from Japanese Patent Application No. 2009-111857 filed on May 1, 2009, the entire subject matter of which is incorporated herein by reference.

TECHNICAL FIELD

The present invention relates to a photosensitive unit and a tandem photosensitive unit for an image forming apparatus.

BACKGROUND

As a photosensitive unit, there has been proposed a known photosensitive member cartridge including: a photosensitive member frame; and a photosensitive drum and a cleaning unit, which are supported by the photosensitive member frame.

An electrostatic latent image is formed on a surface of the photosensitive drum. The electrostatic latent image is visualized by supplying toner and is formed into a toner image. The toner image is then transferred to a sheet.

Paper dust may be adhered to a surface of the photosensitive member at a time of transferring the toner image to the sheet. The cleaning unit serves to remove the paper dust adhered to the surface of the photosensitive drum. The cleaning unit includes a primary cleaning roller, a secondary cleaning roller and a sponge scraper.

In the cleaning unit, the primary cleaning roller is brought into contact with the surface of the photosensitive drum. The paper dust adhered to the surface of the photosensitive drum is captured by the primary cleaning roller, and the captured paper dust is then passed to the secondary cleaning roller from the primary cleaning roller. The paper dust passed to the secondary cleaning roller is scraped off by the sponge scraper and is then stored in a paper dust storage chamber that is provided inside the cleaning unit.

A spring presses the cleaning unit toward the photosensitive drum in order to bring the primary cleaning roller into contact with the photosensitive drum uniformly.

SUMMARY

Illustrative aspects of the present invention provide a photosensitive unit and a tandem photosensitive unit, which are capable of allowing a primary roller for capturing foreign substances on a surface of a photosensitive member to be stably brought into contact with the photosensitive member.

BRIEF DESCRIPTION OF THE DRAWINGS

FIG. 9A is a sectional view taken along the chain line indicated by the arrows A-A of FIG. 8, and FIG. 9B is a sectional view taken along the chain line indicated by the arrows B-B of FIG. 8;

DETAILED DESCRIPTION

<General Overview>

Figure 1:
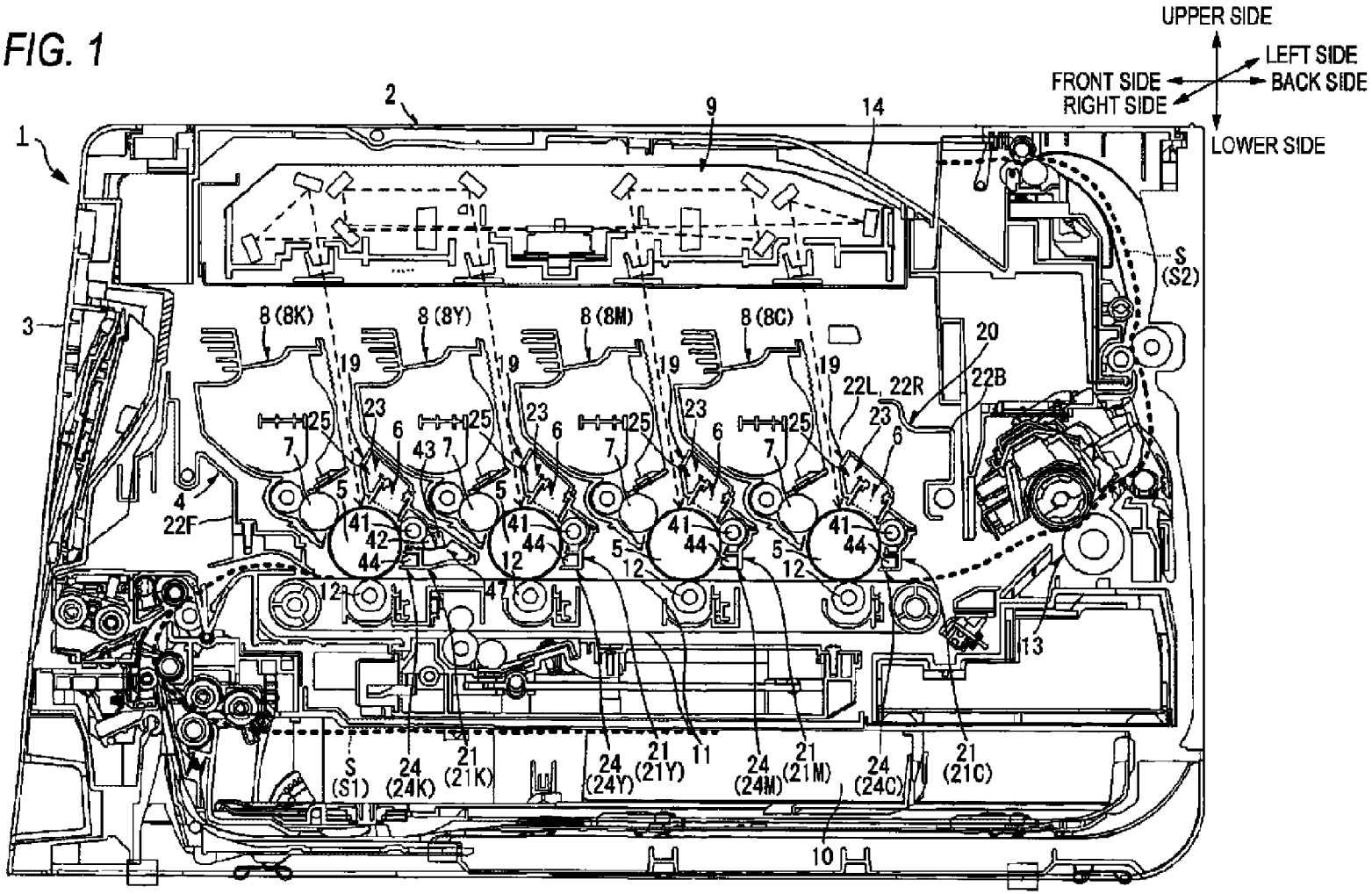
FIG. 1 is a side sectional view showing one example of an image forming apparatus according to an exemplary embodiment of the present invention.

In the above-described known photosensitive member cartridge, the spring presses the entire cleaning unit toward the photosensitive drum. However, the primary cleaning roller is not directly pressed toward the photosensitive drum. Thus, the primary cleaning roller might not be stably brought into contact with the photosensitive drum.

Therefore, illustrative aspects of the present invention provide a photosensitive unit and a tandem photosensitive unit, which are capable of allowing a primary roller for capturing foreign substances on a surface of a photosensitive member to be stably brought into contact with the photosensitive member.

According to a first illustrative aspect of the invention, A photosensitive unit comprising: a photosensitive member that carries a developer image on a surface thereof; a primary roller, which contacts the surface of the photosensitive member, and which captures a foreign substance on the surface of the photosensitive member; a pair of primary bearing members that rotatably support axial end portions of the primary roller; a pair of pressing members that press the pair of primary bearing members toward the photosensitive member; and a pair of guide members that guide the pair of primary bearing members in a pressing direction in which the pair of pressing members press the pair of primary bearing members.

According to a second illustrative aspect of the invention, the photosensitive unit further comprises: a first frame that holds the photosensitive member; and a second frame that holds the primary roller, the pair of primary bearing members and the pair of pressing members.

According to a third illustrative aspect of the invention, in the photosensitive unit, wherein the first frame integrally comprises the pair of guide members.

According to a fourth illustrative aspect of the invention, in the photosensitive unit, wherein the first frame supports the second frame via the pair of guide members.

According to a fifth illustrative aspect of the invention, in the photosensitive unit, wherein the second frame comprises a light guide member that guides light to the surface of the photosensitive member for removing an electronic charge at the surface of the photosensitive member, and wherein the light guide member guides the light to the surface of the photosensitive member at a region upstream of a contact point between the primary roller and the photosensitive member in a rotation direction of the photosensitive member.

According to a sixth illustrative aspect of the invention, in the photosensitive unit, wherein the second frame comprises a light reflecting material.

According to a seventh illustrative aspect of the invention, in the photosensitive unit, wherein the photosensitive member comprises a first gear, wherein the primary roller comprises a second gear at first axial end portion thereof, wherein the second gear intermeshes the first gear so as to rotate the primary roller by a driving force transmitted from the first gear, and wherein the photosensitive unit further comprises: a restricting part, which is provided at an upstream side of the pressing direction with respect to a second axial end portion of the primary roller, and which restricts movement of the second axial end portion of the primary roller toward the upstream side of the pressing direction.

According to an eighth illustrative aspect of the invention, the photosensitive unit further comprises: a secondary roller that contacts a surface of the primary roller to capture a foreign substance on the surface of the primary roller; and a pair of secondary bearing members that rotatably support axial end portions of the secondary roller, wherein each of the pair of guide members comprises: a primary guide part that guides the primary bearing member in the pressing direction; and a secondary guide part that guides the secondary bearing member in the pressing direction.

According to a ninth illustrative aspect of the invention, the photosensitive unit further comprises: a foreign substance container that contains the foreign substance captured by the secondary roller.

According to a tenth illustrative aspect of the invention, the photosensitive member further comprises: a charger that electrically charges the surface of the photosensitive drum.

According to an eleventh illustrative aspect of the invention, there is provided a tandem photosensitive unit that is detachably attached to an image forming apparatus body, the tandem photosensitive unit comprising: a plurality of photosensitive units aligned in a conveyance direction of a recording medium, wherein a first photosensitive unit selected from the plurality of photosensitive units is located at the most upstream side of the conveyance direction, wherein the first photosensitive unit comprises: a first photosensitive member that carries a developer image on a surface thereof; a first primary roller, which contacts the surface of the photosensitive member, and which captures a foreign substance on the surface of the first photosensitive member; a first pair of primary bearing members that rotatably support axial end portions of the first primary roller; a first pair of pressing members that press the first pair of primary bearing members toward the first photosensitive member; a first pair of guide members that guide the first pair of primary bearing members in a pressing direction in which the first pair of pressing members press the first pair of primary bearing members; a first secondary roller that contacts a surface of the first primary roller to capture a foreign substance on the surface of the first primary roller; and a first pair of secondary bearing members that rotatably support axial end portions of the first secondary roller, wherein each of the first pair of guide members comprises: a primary guide part that guides the first primary bearing member in the pressing direction; and a secondary guide part that guides the secondary bearing member in the pressing direction, and wherein a second photosensitive unit selected from the plurality of photosensitive units is located at a downstream side of the conveyance direction with respect to the first photosensitive unit, wherein the second photosensitive unit comprises: a second photosensitive member that carries a developer image on a surface thereof; a second primary roller, which contacts the surface of the second photosensitive member, and which captures a foreign substance on the surface of the second photosensitive member; a pair of second primary bearing members that rotatably support axial end portions of the second primary roller; a second pair of pressing members that press the second pair of primary bearing members toward the second photosensitive member; and a second pair of guide members that guide the second pair of primary bearing members in a pressing direction in which the second pair of pressing members press the second pair of primary bearing members, wherein the second photosensitive unit does not contain a secondary roller.

According to the first illustrative aspect of the invention, in the photosensitive unit, the primary roller comes into contact with the surface of the photosensitive member, on which a developer image is to be formed, and captures a foreign substance on the surface of the photosensitive member. The axial end portions of the primary roller are rotatably supported by the pair of primary bearing members.

Further, the pair of pressing members presses the pair of primary bearing members toward the photosensitive member. Therefore, the primary roller can be directly pressed toward the photosensitive member. Moreover, the pair of guide members guides the pair of primary bearing members in the pressing direction (hereinafter simply referred to as the "pressing direction") in which the pressing members press the primary bearing members. Therefore, the primary roller can be accurately pressed toward the photosensitive member.

As a result, the primary roller can be stably brought into contact with a photosensitive drum.

According to the second illustrative aspect of the invention, the first frame holds the photosensitive member, while the second frame holds the primary roller, the pair of primary bearing members and the pair of pressing members.

In other words, the primary roller, the pair of primary bearing members and the pair of pressing members are unitized in the second frame. Therefore, the photosensitive unit can be easily completed by performing a simple operation in which the first and second frames are combined with each other.

According to the third illustrative aspect of the invention, the guide members are integrally formed with the first frame. Thus, the relative positions of the photosensitive member held by the first frame and the guide members are stabilized. Therefore, the guide members are capable of accurately guiding the primary bearing members in the pressing direction (i.e., direction extending toward the photosensitive member).

According to the fourth illustrative aspect of the invention, the second frame is supported by the first frame via the guide members. Thus, the guide members serve to connect the first and second frames to each other in addition to guide the primary bearing members. Therefore, the number of components can be reduced.

According to the fifth illustrative aspect of the invention, the light guide member guides the light for removing electric charges at the surface of the photosensitive member, so that the light is guided to the region of the surface of the photosensitive member, which is immediately before coming into contact with the primary roller. Thus, electric charges are removed from the region of the surface of the photosensitive member coming into contact with the primary roller, and the primary roller is capable of smoothly capturing foreign substances on the surface of the photosensitive member without being influenced by the electric charges at the surface of the photosensitive member.

Furthermore, the number of components can be reduced by providing the light guide member in the second frame because a member for supporting the light guide member does not have to be additionally provided.

According to the sixth illustrative aspect of the invention, the second frame is formed of a light reflecting material. Thus, the second frame is capable of helping the light guide member in guiding the light to the surface of the photosensitive member.

According to the seventh illustrative aspect of the invention, the second gear is provided at the one axial end portion of the primary roller. The second gear intermeshes the first gear of the photosensitive member and rotates the primary roller by a driving force transmitted from the first gear.

Therefore, in the primary roller, the position of the one axial end portion side is stabilized, but the position of the other axial end portion side is not stable as the position of the one axial end portion side. Thus, the other axial end portion side might be deviated toward the upstream side in the pressing direction and might not be able to stably come into contact with the surface of the photosensitive member. Hence, at the other axial end portion side, the primary roller might not be able to capture foreign substances on the surface of the photosensitive member.

To cope with this, the restricting part is provided at the upstream side of the pressing direction with respect to the other axial end portion of the primary roller. The restricting part restricts the movement of the other axial end portion of the primary roller toward the upstream side of the pressing direction. Thus, the position of the other axial end portion of the primary roller is stabilized similarly to that of the one axial end portion side. As a result, the primary roller can be stably brought into contact with the surface of the photosensitive member at both of the one axial end portion side and other axial end portion side. Therefore, the primary roller is capable of reliably capturing foreign substances on the surface of the photosensitive member across the entire axial direction thereof.

According to the eighth illustrative aspect of the invention, the secondary roller comes into contact with the surface of the primary roller and captures foreign substances on the surface of the primary roller so as to restore the ability of the primary roller to capture foreign substances on the surface of the photosensitive member. The axial end portions of the secondary roller are rotatably supported by the pair of secondary bearing members.

Incidentally, each guide member includes the primary guide part and secondary guide part.

The primary guide part guides the primary bearing member in the pressing direction. Therefore, the primary roller can be accurately pressed toward the photosensitive member, and the primary roller can be stably brought into contact with the photosensitive drum.

The secondary guide part guides the secondary bearing member in the pressing direction. Therefore, the secondary bearing member is allowed to follow the primary bearing member guided in the pressing direction by the primary guide part, and the secondary roller can maintain the state in which the secondary roller is brought into contact with the surface of the primary roller. As a result, the secondary roller is capable of stably coming into contact with the surface of the primary roller and capturing foreign substances on the surface of the primary roller.

According to the ninth illustrative aspect of the invention, the foreign substance container contains the foreign substances captured by the secondary roller. Therefore, the foreign substances on the surface of the photosensitive member can be reliably collected, and the ability of the secondary roller to capture the foreign substances on the surface of the primary roller can be restored.

According to the eleventh illustrative aspect of the invention, the tandem photosensitive unit holds a plurality of photosensitive units in such a manner that the photosensitive units are aligned in the conveyance direction of a recording medium on which a developer image is to be transferred (which will hereinafter be simply referred to as the "conveyance direction"), and the tandem photosensitive unit is detachably attached to the body of an image forming apparatus. Therefore, maintenance of each photosensitive unit can be performed by attaching/detaching the tandem photosensitive unit to/from the body of the image forming apparatus.

Incidentally, among the plurality of photosensitive units, foreign substances (paper dust) of a recording medium are more likely to adhere to the surface the photosensitive member in the first photosensitive unit located at the most upstream side in the conveyance direction, as compared with the second photosensitive unit located at the downstream side of the conveyance direction with respect to the first photosensitive unit. Thus, unlike the primary roller of the second photosensitive unit, the primary roller of the first photosensitive unit will capture a large amount of paper dust.

Therefore, the first photosensitive unit includes both of the primary and secondary rollers. Thus, in the first photosensitive unit, the primary roller is capable of reliably capturing a large amount of foreign substances on the surface of the photosensitive member while the ability of the primary roller to capture the foreign substances on the surface of the photosensitive member is restored by the secondary roller.

On the other hand, unlike the primary roller of the first photosensitive unit, the primary roller of the second photosensitive unit will hardly capture paper dust. This is because paper dust of a recording medium, which will be adhered to the photosensitive member, is mostly adhered to the photosensitive member of the first photosensitive unit located at the upstream side of the conveyance direction. Accordingly, the second photosensitive unit includes only the primary roller instead of including both of the primary and secondary rollers.

In other words, in each of the first and second photosensitive units, settings are made to provide both of the primary and secondary rollers or provide only the primary roller in an unwasteful manner depending on whether or not paper dust can be adhered to the surface of the photosensitive member.

As a result, the number of components in the tandem photosensitive unit can be reduced, and a size of the tandem photosensitive unit can be reduced.

EXEMPLARY EMBODIMENTS

Exemplary embodiments of the present invention will now be described with reference to the drawings.

(1) Image Forming Apparatus

Referring to FIG. 1, an image forming apparatus 1 according to the exemplary embodiment of the present invention will be described. Incidentally, reference is made to the directions indicated by arrows shown in the figures. In the exemplary embodiment, a right-left direction and a widthwise direction (i.e., a direction perpendicular to the plane of FIG. 1) coincide with each other, and an up-down direction and a vertical direction coincide with each other. Further, a horizontal direction includes the widthwise direction and front-back direction. Furthermore, the "left side" in FIG. 1 means the depth side in the direction perpendicular to the plane of FIG. 1, while the "right side" in FIG. 1 means the frontward side in the direction perpendicular to the plane of FIG. 1. Moreover, a "widthwise inner region" means a region located in the vicinity of the widthwise center of the image forming apparatus 1.

A tandem color laser printer is one example of the image forming apparatus 1. The image forming apparatus 1 includes a body casing 2 (one example of an image forming apparatus body). The body casing 2 includes a front cover 3 at a front face thereof. The front cover 3 is (Tenable and closable with respect to the body casing 2.

A tandem photosensitive unit 4 is provided inside of the body casing 2. With the front cover 3 opened, the tandem photosensitive unit 4 is detachably attached to the inside of the body casing 2 through an attachment/detachment opening formed at the front face of the body casing 2.

In the tandem photosensitive unit 4, four photosensitive drums 5 (one example of a photosensitive member) are located in parallel along the front-back direction so as to be rotatable. A scorotron-type charger 6 and a developing roller 7 are located so as to be opposed to each photosensitive drum 5. A developing cartridge 8 for holding the developing roller 7 and accommodating toner (developer) is located above and adjacent to each photosensitive drum 5. The number of the developing cartridges 8 provided is four, which is equal to the number of the photosensitive drums 5. The developing cartridges 8 are inserted into the tandem photosensitive unit 4 (a unit frame 20 described later, to be exact) so as to be detachably attached thereto, with the developing cartridges 8 located in parallel along the front-back direction.

In the exemplary embodiment, the four developing cartridges 8 are distinguished from each other in accordance with colors of toner accommodated in the respective developing cartridges 8 as follows. The developing cartridges S for black, yellow, magenta and cyan are defined as a developing cartridge 8K (black), a developing cartridge 8Y (yellow), a developing cartridge 8M (magenta), and a developing cartridge 8C (cyan), respectively. For example, from the front side, these developing cartridges 8 are arranged in the following order: the developing cartridge 8K, the developing cartridge 8Y, the developing cartridge 8M and the developing cartridge 8C.

In each developing cartridge 8, the toner of the developing cartridge 8 is held at an outer peripheral face (surface) of the developing roller 7. The surface of each developing roller 7 is brought into contact with an outer peripheral face (surface) of the associated photosensitive drum 5 from the upper front side.

The outer peripheral faces of the respective photosensitive drums 5 are each electrically charged uniformly by the charger 6, and are then exposed to laser beams (see the broken lines with arrows shown in FIG. 1) emitted from a scanner unit 9 provided at an upper part of the body casing 2. Thus, electrostatic latent images, which are based on image data, are formed on the outer peripheral faces of the respective photosensitive drums 5. The electrostatic latent images of the respective photosensitive drums 5 are visualized by the toner held at the outer peripheral faces of the developing rollers 7 associated with the respective photosensitive drums 5, and toner images (developer images) are formed on the outer peripheral faces of the respective photosensitive drums 5. In the exemplary embodiment, the colors of toner accommodated in the developing cartridges 8 are different from one developing cartridge 8 to another as described above. Therefore, the colors of the toner images on the photosensitive drums 5 are different from one photosensitive drum 5 to another.

At a bottom part of the body casing 2, there is located a sheet feeding tray 10 that accommodates sheets S (one example of a recording medium). The sheets S accommodated in the sheet feeding tray 10 are each conveyed to an upper face of a belt 11 by various rollers as indicated by a thick dotted line identified by the reference character "S1".

The belt 11 is located so as to be opposed to the four photosensitive drums 5 from below. Transfer rollers 12 are located at respective positions opposed to the photosensitive drums 5, with an upper side portion of the belt 11 sandwiched between the transfer rollers 12 and the photosensitive drums 5. The sheets S conveyed onto the belt 11 are sequentially passed through a passage between the belt 11 and the respective photosensitive drums 5 toward the back side by the running of the belt 11. Furthermore, the toner image on the outer peripheral face of each photosensitive drum 5 is transferred to the sheet S by means of a transfer bias applied to the associated transfer roller 12 when the toner image is opposed to (or brought into contact with) the sheet S.

At the downstream side (back side in FIG. 1) in the conveyance direction of the sheets S with respect to the belt 11, a fixing device 13 is provided. The sheets S to which the toner images have been transferred are passed to the fixing device 13 from the belt 11. In the fixing device 13, the toner images are fixed to the sheets S by application of heat and pressure. The sheets S to which the toner images have been fixed are discharged to a sheet discharge tray 14 at an upper face of the body casing 2 by various rollers as indicated by a thick dotted line identified by the reference character "S2".

(2) Tandem Photosensitive Unit

Next, the tandem photosensitive unit 4 will be described in detail.

(2-1) Overall Structure of Tandem Photosensitive Unit

The tandem photosensitive unit 4 includes: the unit frame 20 that forms the outline of the tandem photosensitive unit 4; four photosensitive units 21 each including one of the above-described photosensitive drums 5; and the four developing cartridges 8 described above.

The unit frame 20 has a substantially rectangular frame shape extending longitudinally in the front-back direction as seen in the up-down direction. The unit frame 20 integrally includes four lateral plates 22 (i.e., a front side plate 22F, a back side plate 22B, a left side plate 22L and a right side plate 22R), which form four sides of the substantially rectangular shape. In the unit frame 20, a space surrounded by these four lateral plates 22 is opened toward both of the top and bottom.

The four photosensitive units 21 are located in parallel along the front-back direction at substantially regular intervals. In this state, the four photosensitive units 21 are provided between a lower end portion of the left side plate 22L and that of the right side plate 22R and are supported by the unit frame 20. Each photosensitive unit 21 is associated with one of the developing cartridges 8K, 8Y, 8M and 8C, and the four photosensitive units 21 are distinguished from each other as follows. From the front side, the four photosensitive units 21 are defined as a photosensitive unit 21K, a photosensitive unit 21Y, a photosensitive unit 21M, and a photosensitive unit 21C in this order.

Each photosensitive unit 21 includes: one of the photosensitive drums 5; and a sub-unit 19 (which will be described later) located so as to be opposed to the photosensitive drum 5 from the upper back side. When the four photosensitive units 21 located in parallel along the front-back direction are collectively seen, the four photosensitive drums 5 are located in parallel along the front-back direction as described above at substantially regular intervals. In this state, the respective photosensitive drums 5 are provided between the lower end portion of the left side plate 22L and that of the right side plate 22R and are rotatably supported by the unit frame 20.

Moreover, in this state, the lower side outer peripheral face of each photosensitive drum 5 is exposed downward through the unit frame 20. Therefore, with the tandem photosensitive unit 4 inserted into the body casing 2, the lower side outer peripheral face of the photosensitive drum 5 comes into contact with the upper face of the belt 11 from above in each photosensitive unit 21.

In the exemplary embodiment, the direction in which the sheets S are conveyed by the belt 11 is the direction in which the sheets S are sent toward the back side as described above. The four photosensitive units 21 are located in parallel along the front-back direction as described above. Hence, it is clear that the tandem photosensitive unit 4 holds the four photosensitive units 21, with the photosensitive units 21 aligned along the conveyance direction of the sheets S.

Further, among the four photosensitive units 21 located in parallel along the front-back direction, the most frontward photosensitive unit 21K (one example of a first photosensitive unit) is located at the most upstream side of the conveyance direction of the sheets S. Furthermore, the remaining photosensitive units 21Y, 21M and 21C (one example of a second photosensitive unit) are located at the downstream side of the conveyance direction of the sheets S with respect to the photosensitive unit 21K.

With the tandem photosensitive unit 4 detached from the body casing 2, the respective developing cartridges 8 are attached from above to the unit frame 20 (more specifically, a space surrounded by the four lateral plates 22) or detached therefrom. Upon insertion of the developing cartridges 8 into the unit frame 20, the lower side outer peripheral face of each developing roller 7 is brought into contact with the outer peripheral face of the photosensitive drum 5 of the associated photosensitive unit 21 from the upper front side. Thus, at the time of image formation, toner is supplied from the developing roller 7 to the electrostatic latent image on the photosensitive drum 5 to allow the electrostatic latent image to be visualized as described above.

(2-2) Sub-Unit

Hereinafter, the sub-units 19 will be described in detail. However, as will be described later, the structure of the sub-unit 19 of the photosensitive unit 21K for black differs from those of the sub-units 19 of the photosensitive units 21Y, 21M and 21C for colors other than black.

Figure 2A:
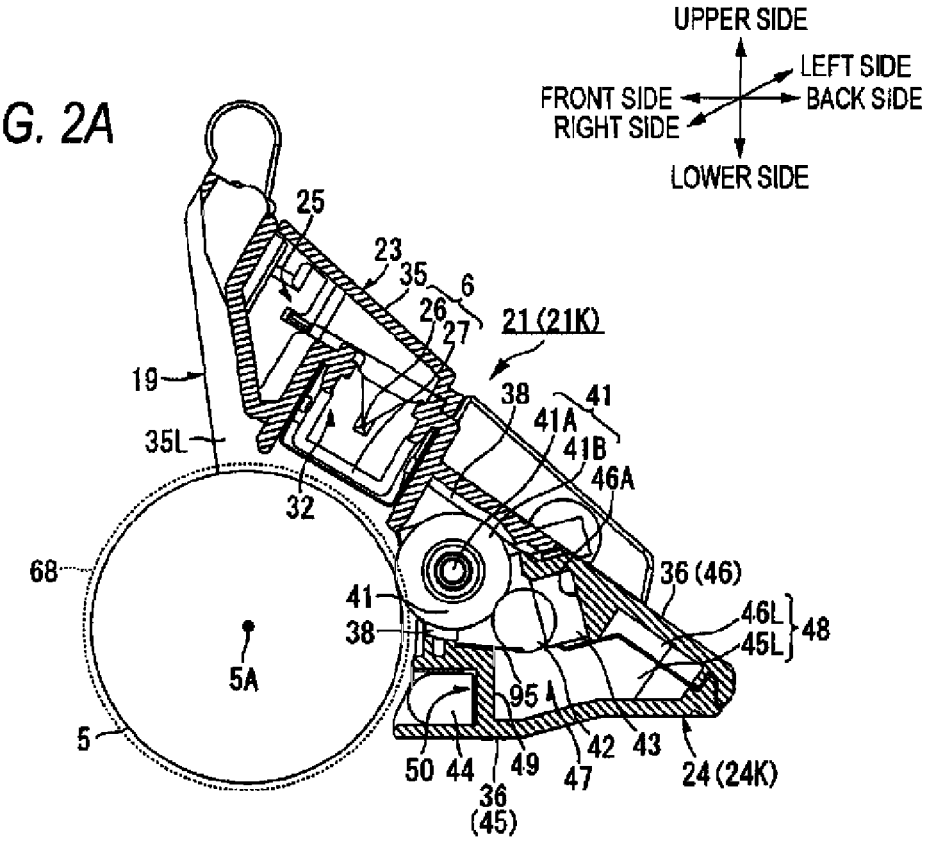
FIG. 2A is a side sectional view of a photosensitive unit for black.
Figure 2B:
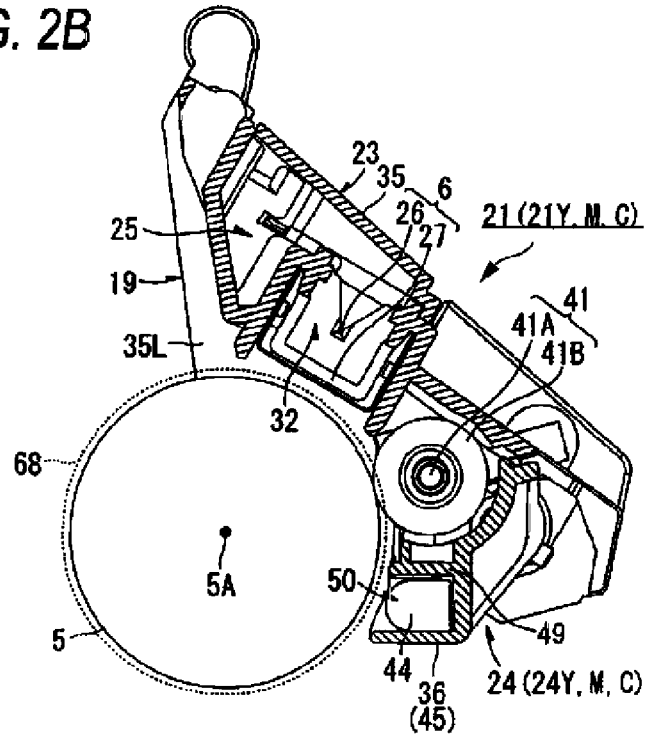
FIG. 2B is a side sectional view of a photosensitive unit for a color other than black.
Figure 3A:
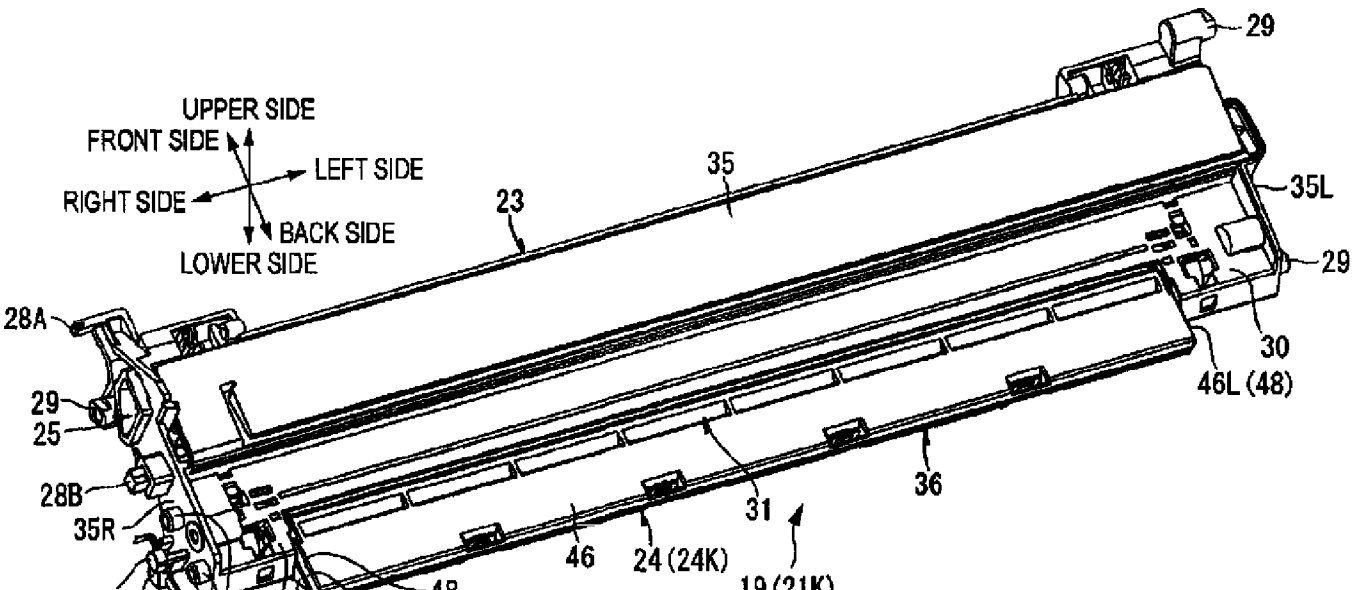
FIG. 3A is a perspective view of the black photosensitive unit (sub-unit), from which a photosensitive drum is removed and which is seen from the upper right rear.
Figure 3B:
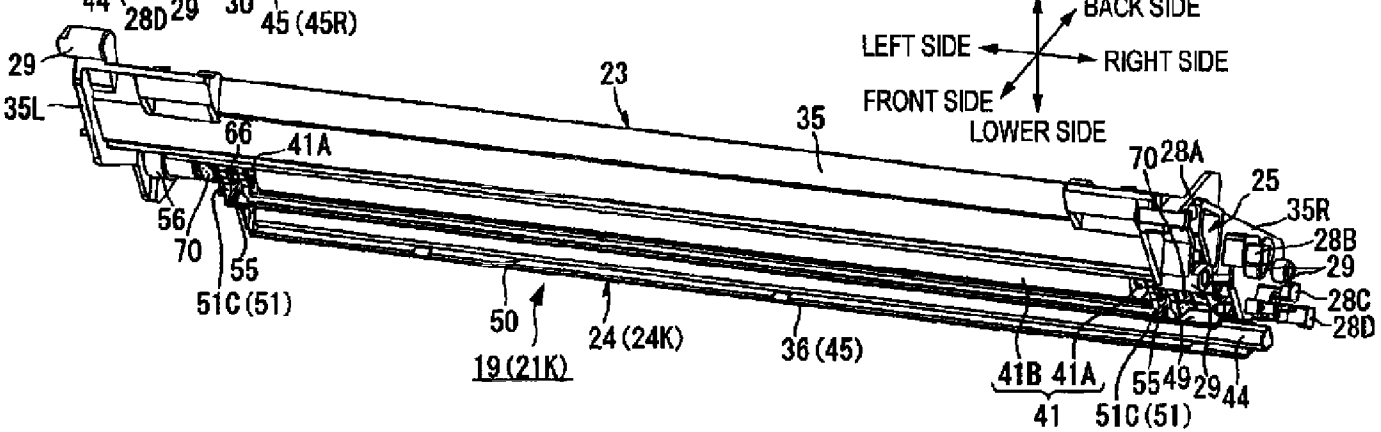
FIG. 3B is a perspective view of the black photosensitive unit (sub-unit), from which a photosensitive drum is removed and which is seen from the right front.

FIG. 2A is a side sectional view of the photosensitive unit for black. FIG. 2B is a side sectional view of the photosensitive unit for a color other than black. FIG. 3A is a perspective view of the black photosensitive unit (sub-unit), from which a photosensitive drum is removed and which is seen from the upper right rear. And FIG. 3B is a perspective view of the black photosensitive unit (sub-unit), from which a photosensitive drum is removed and which is seen from the right front.

Referring to FIGS. 2A and 2B, the sub-unit 19 of each of the photosensitive units 21K, 21Y, 21M and 21C includes a first unit 23 and a second unit 24. The second unit 24 will also be called a "cleaning unit". The structure of the first unit 23 of the photosensitive unit 21K is substantially similar to that of the first unit 23 of each of the photosensitive units 21Y, 21M and 21C, but the structure of the second unit 24 of the photosensitive unit 21K differs from that of the second unit 24 of each of the photosensitive units 21Y, 21M and 21C. Hence, the second units 24 of the photosensitive units 21 are distinguished from each other in accordance with the types thereof (21K, 21Y, 21M and 21C), and are defined as follows: a second unit 24K, a second unit 24Y, a second unit 24M and a second unit 24C.

The following description about the sub-units 19 will be centered on the sub-unit 19 of the photosensitive unit 21K for black (see FIG. 2A).

In each sub-unit 19, the first unit 23 includes a first frame 35 and the charger 6.

The right side cross section of the first frame 35 is illustrated as an area hatched by oblique lines extending toward the upper back side (the same goes for FIGS. 9A, 9B, 10A and 10B described later). The first frame 35 has a rectangular plate-like shape extending longitudinally in the widthwise direction as seen from above (see FIGS. 3A and 3B) and obliquely extends toward the lower back side. As seen in the widthwise direction, an upper front side end portion of the first frame 35 is hollow. This hollow portion is defined as a duct 25.

At a lower face of the first unit 23, a concave portion 32 concaved toward the upper back side is formed at a position adjoining to the duct 25 from the lower back side. The concave portion 32 (more specifically, a space inside the concave portion 32) is communicated with the duct 25. Further, the charger 6 is fitted into the concave portion 32. In each photosensitive unit 21, the charger 6 is opposed to the photosensitive drum 5 from the upper back side at a distance therefrom so that the charger 6 does not come into contact with the photosensitive drum 5.

Hereinafter, the charger 6 will be described in detail. The charger 6 includes; a discharge wire 26 opposed to the upper back side outer peripheral face of the photosensitive drum 5 at a distance therefrom; and a grid 27, which is provided between the discharge wire 26 and the photosensitive drum 5, for controlling the amount of electric charges supplied from the discharge wire 26 to the photosensitive drum 5. In the charger 6, simultaneously with application of a bias to the grid 27, a high voltage is applied to the discharge wire 26 to cause corona discharge in the discharge wire 26. Therefore, the outer peripheral face of the photosensitive drum 5 is electrically charged uniformly as described above.

Furthermore, as shown in FIG. 3A, a plurality of electrodes 28 are provided at a right end face of the first frame 35 so as to be exposed to the right side. These electrodes 28 are distinguished from each other as follows. From the upper front side, the electrodes 28 are defined as a first electrode 28A, a second electrode 28B, a third electrode 28C and a fourth electrode 28D in this order. These electrodes 28 are exposed to the right side through the right side plate 22R (see FIG. 1) of the unit frame 20 and are connected to an electrode (not shown) located at the body casing 2. Thus, electric power from a power source (not shown) of the body casing 2 is supplied to the charger 6 (see FIGS. 2A and 2B) and/or the second unit 24 (more specifically, a primary roller 41 and a secondary roller 42 which will be described later (see FIGS. 2A and 2B)).

More specifically, in the charger 6, the above-described high voltage is applied to the discharge wire 26 (see FIGS. 2A and 2B) from the first electrode 28A, and the above-described bias is applied to the grid 27 (see FIGS. 2A and 2B) from the second electrode 28B. The third and fourth electrodes 28C and 28D will be described later.

Moreover, the duct 25 passes through the first frame 35 in the widthwise direction. At the right end face of the first frame 35, a right end portion of the duct 25 is exposed at a position located above and in front of the second electrode 28B. The duct 25 is exposed to outside in the widthwise direction through each of the left side plate 22L and right side plate 22R (see FIG. 1) of the unit frame 20. Thus, air outside the unit frame 20 flows into the duct 25 to cool the charger 6 (see FIGS. 2A and 28) and/or to remove dust and the like adhered to the discharge wire 26 (see FIGS. 2A and 2B).

A plurality of bosses 29 protruded outward in the widthwise direction is integrally provided at each of right and left end faces of the first frame 35. Each boss 29 is assembled to the lower end portion of the associated one of the left side plate 22L and right side plate 22R (see FIG. 1) of the unit frame 20 from inside in the widthwise direction. Furthermore, as described above, in each photosensitive unit 21, the photosensitive drum 5 (see FIGS. 2A and 2B) is provided between the lower end portion of the left side plate 22L and that of the right side plate 22R and is rotatably supported by the unit frame 20. Thus, each photosensitive unit 21 is provided between the lower end portion of the left side plate 22L and that of the right side plate 22R as described above through the first frame 35 and the photosensitive drum 5 and is supported by the unit frame 20 (see FIG. 1).

In the exemplary embodiment, supposing that regions at which each photosensitive drum 5 is supported by the respective lower end portions of the left side plate 22L and right side plate 22R are defined as parts of the first frame 35 of the photosensitive unit 21 including the photosensitive drum 5, the first frame 35 holds the associated photosensitive drum 5 in each photosensitive unit 21.

In addition, a pair of protrusive portions 30 protruded toward the lower back side is integrally provided at widthwise end portions of a lower back side end of the first frame 35. At the lower back side end of the first frame 35, there is formed a cut-out 31 sandwiched between the pair of protrusive portions 30 and extended longitudinally in the widthwise direction. The second unit 24 is provided so as to be fitted into the cut-out 31.

Next, although the second units 24 will be described, the second unit 24K for black will be described first.

(2-1) Second Unit For Black

Figure 4A:
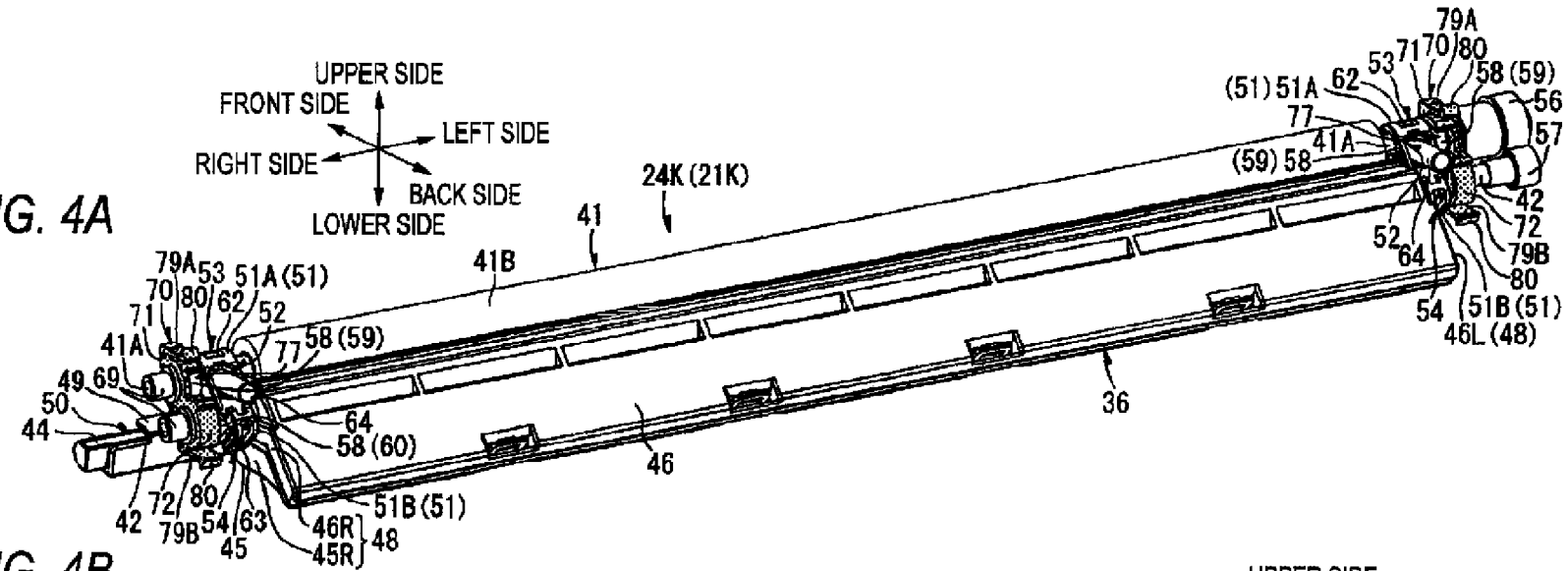
FIG. 4A is a perspective view of a second unit for black, as seen from the upper right rear.
Figure 4B:
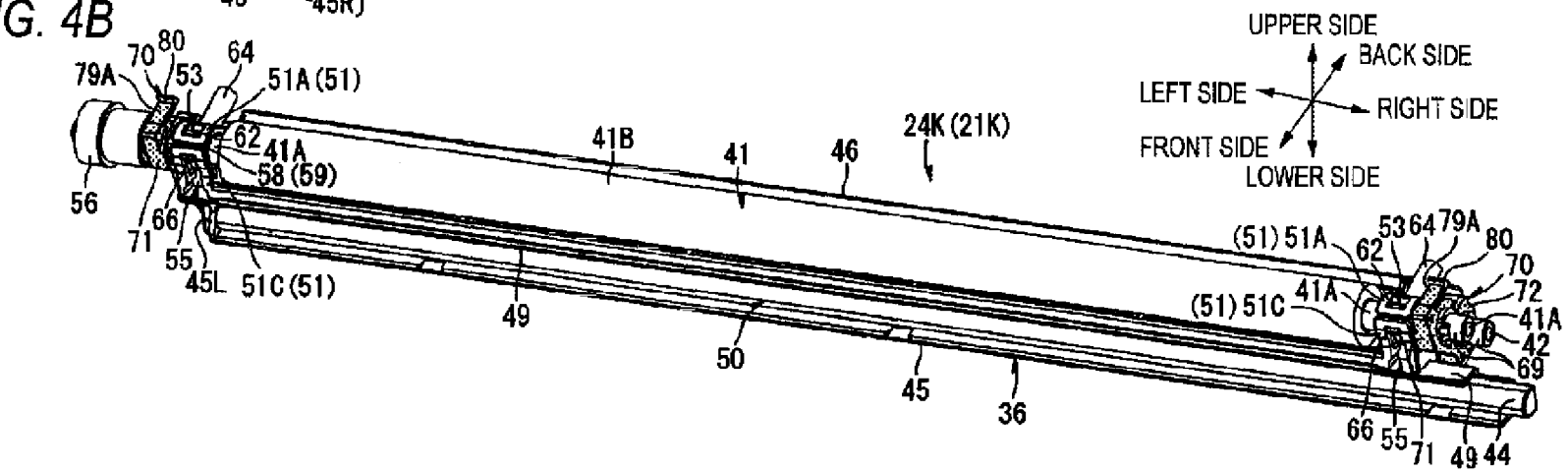
FIG. 4B is a perspective view of the black second unit, as seen from the right front.
Figure 5:
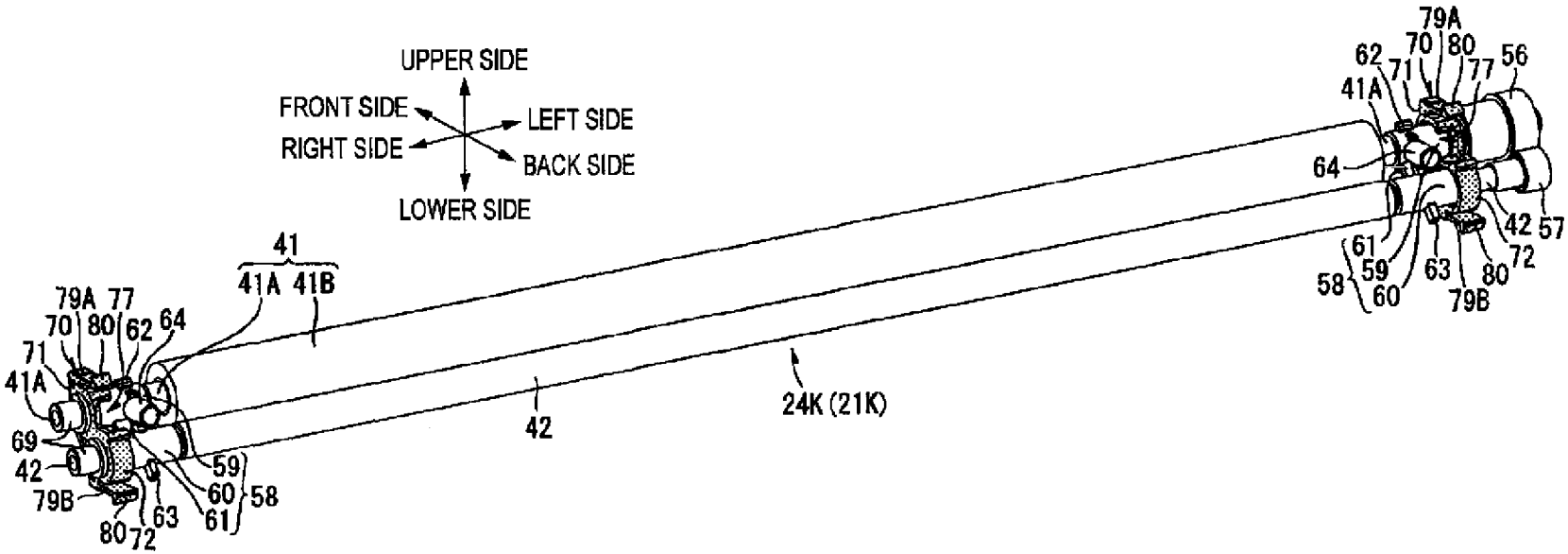
FIG. 5 is a diagram showing principal parts of the black second unit of FIG. 4A.

FIG. 4A is a perspective view of the black second unit as seen from the upper right rear. FIG. 4B is a perspective view of the black second unit as seen from the right front. And FIG. 5 is a diagram showing principal parts of the black second unit of FIG. 4A.

Referring to FIG. 2A, the second unit 24K includes: a second frame 36; the primary roller 41; the secondary roller 42; a scraping member 43; and a light guide member 44.

In the exemplary embodiment, the right side cross section of the second frame 36 in each of the second units 24 is illustrated as an area hatched by oblique lines extending toward the lower back side (the same goes for FIGS. 9A, 9B, 10A and 10B described later), and the second frame 36 in each of the second units 24 extends longitudinally in the widthwise direction.

The right side cross section of the second frame 36 of the second unit 24K has a substantially V shape tapered toward the back side. In order to provide such a right side cross-sectional shape, the second frame 36 of the second unit 24K includes a plate-like lower frame 45 and a plate-like upper frame 46 in a dividable manner. The plate-like lower frame 45 is elongated longitudinally in the widthwise direction and extended substantially horizontally, and the plate-like upper frame 46 is elongated longitudinally in the widthwise direction and extended toward the upper front side from a rear end portion of the lower frame 45. In the second frame 36, a space sandwiched between the lower frame 45 and the upper frame 46 is opened at the upper front side and is communicated with outside. Incidentally, this space will be referred to as a storage chamber 47 (one example of a foreign substance container).

In the exemplary embodiment, an attachment face 46A is formed at a front side portion of a surface (lower face) of the upper frame 46, facing the storage chamber 47 from above. The attachment face 46A is flat along the direction slightly inclined toward the front side with respect to the vertical direction. The scraping member 43 is attached to the attachment face 46A, and the scraping member 43 is located inside the storage chamber 47.

The scraping member 43 has a block shape elongated in the widthwise direction and is formed by a sponge. As seen in the widthwise direction, the scraping member 43 has a substantially rectangular shape extending slightly longitudinally in the up-down direction (strictly speaking, in the direction extending along the attachment face 46A). A rear face of the scraping member 43 is affixed to the attachment face 46A via a double-faced tape or the like. A front face of the scraping member 43 is facing, from the back side, a portion of the storage chamber 47 opened toward the upper front side.

Moreover, a left end portion 45L of the lower frame 45 is bent at a substantially right angle toward the upper back side, and a left end portion 46L of the upper frame 46 is bent at a substantially right angle toward the lower front side. The left end portion 45L of the lower frame 45 and the left end portion 46L of the upper frame 46, bent in the above-described manner, are fitted to each other, thus closing the left side portion of the storage chamber 47. The left end portions 45L and 46L, which are fitted to each other in this manner, collectively form a closing plate 48 having a substantially triangle shape tapered toward the back side as seen in the widthwise direction.

As shown in FIG. 4A, a right end portion 45R of the lower frame 45 is bent at a substantially right angle toward the upper back side, and a right end portion 46R of the upper frame 46 is bent at a substantially right angle toward the lower front side. The right end portion 45R of the lower frame 45 and the right end portion 46R of the upper frame 46, bent in the above-described manner, are fitted to each other, thus closing the right side portion of the storage chamber 47 (see FIG. 2A). The right end portions 45R and 46R, which are fitted to each other in this manner, collectively form the closing plate 48.

Further, as shown in FIG. 2A, an extended portion 49 is integrally provided on an upper face of a front end portion of the lower frame 45. The extended portion 49 has a plate-like shape extending longitudinally in the widthwise direction. The extended portion 49 is extended upward from the upper face of the front end portion of the lower frame 45 (more specifically, from a position located slightly rearward of a front end of the lower frame 45) and is then bent at a substantially right angle toward the front side. A concave portion 50 dented toward the back side is defined by the extended portion 49 and the front end portion of the lower frame 45. The concave portion 50 and the storage chamber 47 are partitioned by the extended portion 49.

The concave portion 50 is extended longitudinally in the widthwise direction. A right end portion of the concave portion 50 is more protruded toward the right side than the right side closing plate 48 (see FIG. 4A). As seen in the widthwise direction, at the front end portion and extended portion 49 of the lower frame 45, regions by which upper and lower sides of the concave portion 50 are defined each have a flat face extending along a substantially horizontal direction, and a region by which a back side of the concave portion 50 is defined has a flat face extending along a substantially vertical direction.

The light guide member 44 is accommodated in the concave portion 50 so as to be fitted thereto from the front side. In other words, the light guide member 44 is provided at the second frame 36 where the concave portion 50 is defined.

The light guide member 44 has a rod-like shape elongated in the widthwise direction and is formed of transparent glass or resin. The widthwise dimension of the light guide member 44 is larger than that of the outer peripheral face of the photosensitive drum 5. Similarly to the right end portion of the concave portion 50, a right end portion of the light guide member 44 is more protruded toward the right side than the right side closing plate 48 (see FIG. 4A).

As seen in the widthwise direction, the light guide member 44 has a substantially rectangular shape extending slightly longitudinally in the front-back direction. In the exemplary embodiment, each of upper and lower faces of the light guide member 44 is a flat face extending along a substantially horizontal direction, and a rear face of the light guide member 44 is a flat face extending along a substantially vertical direction. The upper, lower and rear faces of the light guide member 44 accommodated in the concave portion 50 are covered with the regions by which the concave portion 50 is defined at the front end portion and extended portion 49 of the lower frame 45. On the other hand, a front face of the light guide member 44 is a curved surface bulged toward the front side in the form of a segment of a circle and is exposed to the front side through the concave portion 50. Functions of the light guide member 44 will be described later.

Furthermore, as shown in FIGS, 4A and 4B, a holding part 51 is integrally provided at each of widthwise end portions of the second frame 36. In other words, a pair of the holding parts 51 is provided at a distance in the widthwise direction.

Each holding part 51 includes: a first holding portion 51A; a second holding portion 51B (see FIG. 4A); and a third holding portion 51C (see FIG. 413).

In the left side holding part 51, the first and second holding portions 51A and 51B are integrally provided at an upper front side end part of the left end portion 46L of the upper frame 46 (see FIG. 4A). The third holding portion 51C is integrally provided at a left end part of an upper front side end portion of the extended portion 49 of the lower frame 45 (see FIG. 4B).

In the right side holding part 51, the first and second holding portions 51A and 51B are integrally provided at an upper front side end part of the right end portion 46R of the upper frame 46 (see FIG. 4A). The third holding portion 51C is integrally provided at a right end part of an upper front side end portion of the extended portion 49 of the lower frame 45 (see FIG, 4B), In each of the right and left holding parts 51, the first holding portion 51A has a plate-like shape. The first holding portion 51A is extended toward the upper front side from an upper front end portion of the associated one of the left end portion 46L and right end portion 46R of the upper frame 46 (see FIG. 4A) and is then extended toward the front side while being bent (see FIG. 4B). The first holding portion 51A includes a through hole (which will be referred to as an "insertion hole 52") at a back side portion extending toward the upper front side. Further, the first holding portion 51A includes another through hole (which will be referred to as a "first through hole 53") at a front side portion extending toward the front side while being bent.

In each of the right and left holding parts 51, the second holding portion 51B has a plate-like shape and is continuous with a rear end part of the first holding portion 51A located at the same side in the widthwise direction. The second holding portion 51B is extended toward the lower back side from this rear end part of the first holding portion 51A and is then bent so as to be extended toward the lower front side (see FIG. 4A). In the second holding portion 51B, there is formed a through hole (which will be referred to as a "second through hole 54") extended longitudinally in the up-down direction as seen from the back side.

In each of the right and left holding parts 51, the third holding portion 51C has a plate-like shape as shown in FIG. 4B, and is extended upward toward a front end part of the first holding portion 51A, located at the same side in the widthwise direction, from an end portion of the extended portion 49 located at the same side in the widthwise direction at the upper front side end portion thereof (see also FIGS. 9B and 10A described later). An upper end portion of the third holding portion 51C is opposed from the lower front side to the front end part of the first holding portion 51A located at the same side in the widthwise direction, with a slight gap provided between the upper end portion of the third holding portion 51C and the front end part of the first holding portion 51A. In the third holding portion 51C, there is formed a through hole (which will be referred to as a "third through hole 55") extended longitudinally in the up-down direction as seen from the front side.

Next, the primary roller 41 and the secondary roller 42 will be described.

Regarding the primary roller 41 and the secondary roller 42, the upper one of the two rollers shown in FIG. 5 is the primary roller 41, and the lower one of the two rollers shown in FIG. 5 is the secondary roller 42.

The primary roller 41 is extended longitudinally in the widthwise direction. The primary roller 41 integrally includes: a columnar shaft portion 41A made of metal and elongated in the widthwise direction; and a roller portion 41B that covers regions of an outer peripheral face of the shaft portion 41A except widthwise end portions thereof. The shaft portion 41A is elongated in the widthwise direction, and thus the axial direction of the primary roller 41 coincides with the widthwise direction. The roller portion 41B is formed of foam (e,g., sponge). A gear is provided at a left end portion of the primary roller 41 (i.e., one axial end portion of the primary roller 41). This gear will be referred to as a primary gear 56 (one example of a second gear). The primary gear 56 has a substantially cylindrical shape with a center axis extending in the widthwise direction, and gear teeth are formed at an outer peripheral face of the primary gear 56.

The secondary roller 42 is made of metal and has a columnar shape elongated in the widthwise direction. Therefore, the axial direction of the secondary roller 42 coincides with the widthwise direction. A gear (which will be referred to as a "secondary gear 57") is provided at a left end portion of the secondary roller 42. The secondary gear 57 has a substantially cylindrical shape with a center axis extending in the widthwise direction, and gear teeth are formed at an outer peripheral face of the secondary gear 57.

The widthwise dimension of the primary roller 41 and that of the secondary roller 42 are substantially equal to each other.

Respective end portions of the primary and secondary rollers 41 and 42, located at the same side in the widthwise direction, are rotatably supported by the same bearing member 58. In other words, a pair of the bearing members 58 for rotatably supporting axial end portions of both of the primary and secondary rollers 41 and 42 is provided at the second unit 24.

Each bearing member 58 has a substantially "8" shape as seen in the widthwise direction. With reference to the position shown in FIG. 5 (which is a position when the bearing members 58 are assembled inside the image forming apparatus 1), each bearing member 58 integrally includes: an upper front side primary bearing member 59; a lower back side secondary bearing member 60; and a connecting portion 61 through which the primary and secondary bearing members 59 and 60 are connected.

Both of the primary and secondary bearing members 59 and 60 each have a substantially cylindrical shape, a center axis of which extends in the widthwise direction.

A convex portion (which will be referred to as a "first convex portion 62") projected upward (see also FIGS. 9B and 10A) is integrally provided on an upper side outer peripheral face of the primary bearing member 59. Furthermore, a front end of a coil spring 64 (one example of a pressing member) extending longitudinally in the front-back direction is attached to a back side outer peripheral face of the primary bearing member 59. The coil spring 64 is integrally formed with the bearing member 58. More specifically, a boss 65 (see FIGS. 9B and 10A) projected rearward is integrally provided on a back side outer peripheral face of the primary bearing member 59, and the front end of the coil spring 64 is externally fitted to the boss 65. Since the primary bearing members 59 of the right and left bearing members 58 each include one coil spring 64, a pair of the coil springs 64 is provided at a distance in the widthwise direction.

Figure 10A:
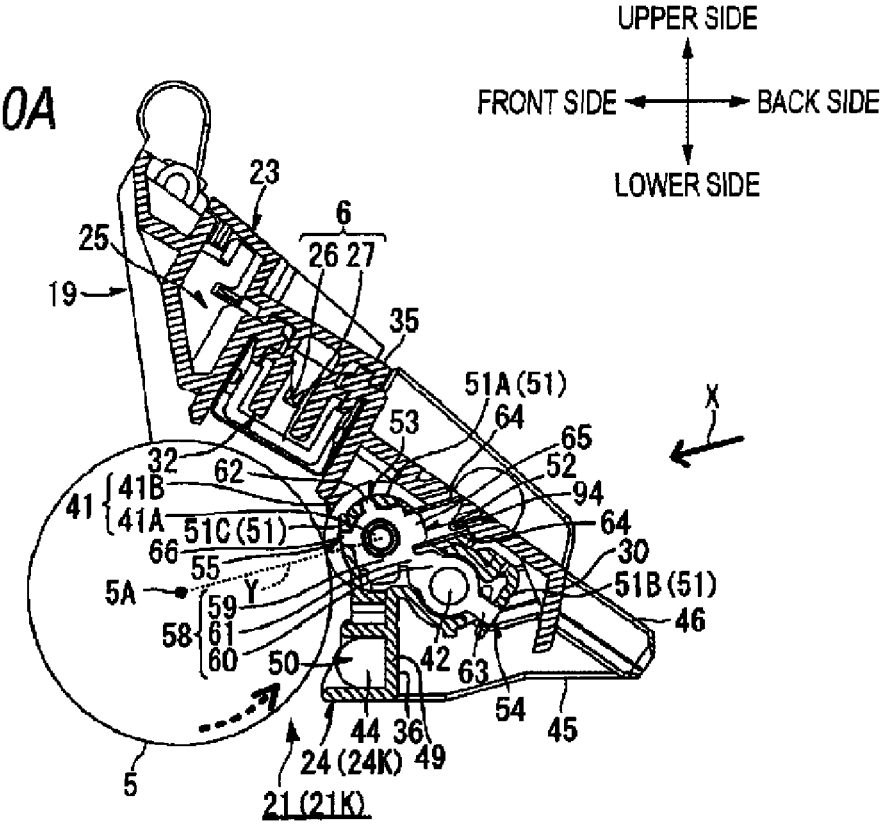
FIG. 10A is a sectional view taken along the chain line indicated by the arrows C-C of FIG. 8.

A convex portion (which will be referred to as a "second convex portion 63") projected toward the lower back side is integrally provided on a lower side outer peripheral face of the secondary bearing member 60 (see also FIGS. 9B and 10A).

Furthermore, A convex portion (which will be referred to as a "third convex portion 66") projected frontward is integrally provided on a front side outer peripheral face of the primary bearing member 59 (sec FIGS. 4B, 9B and 10A).

In each bearing member 58, the first, second and third convex portions 62, 63 and 66 are located at substantially the same positions with respect to the widthwise direction. More specifically, the first, second and third convex portions 62, 63 and 66 are located at the positions located inwardly of the widthwise center of the bearing member 58 in the widthwise direction (in the case of the right side bearing member 58, at the positions located leftwardly of the widthwise center) (see also FIGS. 9B and 10A):

The connecting portion 61 has a substantially rectangular parallelepiped block shape. The connecting portion 61 is provided between a widthwise center portion of the Lower side outer peripheral face of the primary bearing member 59 and that of the upper side outer peripheral face of the secondary bearing member 60. In each bearing member 58, the connecting portion 61 is located outwardly of the first, second and third convex portions 62, 63 and 66 in the widthwise direction (in the case of the right side bearing member 58, the connecting portion 61 is located rightwardly of the first, second and third convex portions 62, 63 and 66 in the widthwise direction).

In the primary roller 41, a right end part of the shaft portion 41A is inserted into a hollow portion of the primary bearing member 59 of the right side bearing member 58 and is rotatably supported by the primary bearing member 59. A left end part of the shaft portion 41A (more specifically, a part of the shaft portion 41A, located rightwardly of the primary gear 56) is inserted into a hollow portion of the primary bearing member 59 of the left side bearing member 58 and is rotatably supported by the primary bearing member 59. Thus, widthwise end portions of the primary roller 41 are rotatably supported by the pair of right and left bearing members 58 (i.e., the primary bearing members 59 thereof).

A right end part of the secondary roller 42 is inserted into a hollow portion of the secondary bearing member 60 of the right side bearing member 58 and is rotatably supported by the secondary bearing member 60. A left end part of the secondary roller 42 (more specifically, a part of the secondary roller 42, located rightwardly of the secondary gear 57) is inserted into a hollow portion of the secondary bearing member 60 of the right side bearing member 58 and is rotatably supported by the secondary bearing member 60. Thus, widthwise end portions of the secondary roller 42 are rotatably supported by the pair of right and left bearing members 58 (i.e., the secondary bearing members 60 thereof).

In the state where the primary and secondary rollers 41 and 42 are each supported by the right and left bearing members 58 in this manner, regions of the upper side outer peripheral face of the secondary roller 42 except the widthwise end portions thereof come into contact with the lower side outer peripheral face of the roller portion 41B of the primary roller 41 across the entire widthwise direction thereof from the lower back side. The primary gear 56 of the primary roller 41 intermeshes the secondary gear 57 of the secondary roller 42 from the upper front side.

In the exemplary embodiment, the second frame 36 (see FIGS. 4A and 4B) is fixed to the right and left bearing members 58.

More specifically, referring to FIGS. 4A and 4B, a widthwise inner portion of the primary bearing member 59 (see FIG. 5) of the bearing member 58 located at the same side in the widthwise direction is fitted between the first and third holding portions 51A and 51C in each of the right and left holding parts 51 of the second frame 36 (see FIG. 4B). Moreover, the secondary bearing member 60 (see FIG. 5) of the bearing member 58 located at the same side in the widthwise direction is fitted from front to the second holding portion 51B in each of the right and left holding parts 51 (see FIG. 4A).

In this state, in each bearing member 58, the first convex portion 62 (see FIG. 5) of the primary bearing member 59 is fitted from the lower side into the first through hole 53 of the first holding portion 51A located at the same side in the widthwise direction and is thus engaged with the first holding portion 51A (see FIGS. 4A, 4B, 9B and 10A). Further, the second convex portion 63 of the secondary bearing member 60 is fitted from front into the second through hole 54 of the second holding portion 51B located at the same side in the widthwise direction and is thus engaged with the second holding portion 51B (see FIGS. 4A, 9B and 10A). Furthermore, the third convex portion 66 of the primary bearing member 59 is fitted from the back side into the third through hole 55 of the third holding portion 51C located at the same side in the widthwise direction and is thus engaged with the third holding portion 51C (see FIGS. 4B, 9B and 10A).

Thus, the second frame 36 holds the respective bearing members 58 in the right and left holding parts 51 so that the bearing members 58 will not be detached therefrom. In other words, the second frame 36 is fixed to the respective bearing members 58. Furthermore, in this state, the coil spring 64 of the primary bearing member 59 (see FIG. 5) located at the same side in the widthwise direction is inserted from the front side into the insertion hole 52 of each of the right and left first holding portions 51A and is protruded toward the back side through the first holding portion 51A as shown in FIG. 4A.

In this state, the second unit 24 is completed. In the second unit 24, the second frame 36 holds the primary roller 41, the secondary roller 42, the scraping member 43, the light guide member 44, the pair of bearing members 58 and the pair of coil springs 64 (see also FIG. 2A).

In the completed second unit 24 (24K), as shown in FIG. 2A, a lower back side outer peripheral face of the roller portion 41B of the primary roller 41 closes the opened upper front side portion of the storage chamber 47 while facing the inside of the storage chamber 47 from the upper front side; on the other hand, other regions of the outer peripheral face of the roller portion 41B are exposed to outside (see also FIGS. 4A and 4B). In the exemplary embodiment, the lower back side outer peripheral face of the roller portion 41B closes the opened upper front side portion of the storage chamber 47. Therefore, the storage chamber 47 is hermetically sealed. Incidentally, a gap between the outer peripheral face of the roller portion 41B and the second frame 36 is appropriately closed by a sealing member 38, thus maintaining the hermeticity of the storage chamber 47.

Moreover, a part of the secondary roller 42 sandwiched between widthwise end portions thereof is accommodated in the storage chamber 47. The upper front side outer peripheral face of the secondary roller 42 is brought into contact with the lower back side outer peripheral face of the roller portion 41B of the primary roller 41 across the entire widthwise direction thereof from the lower back side, and the back side outer peripheral face of the secondary roller 42 digs into the front face of the scraping member 43 across the entire widthwise direction thereof from the front side.

As shown in FIG. 5, a guide member 70 is attached to each of the right and left bearing members 58 (each guide member 70 is indicated by dots). In other words, a pair of the guide members 70 is provided at a distance in the widthwise direction. The pair of guide members 70 is included in each photosensitive unit 21.

Figure 6A:
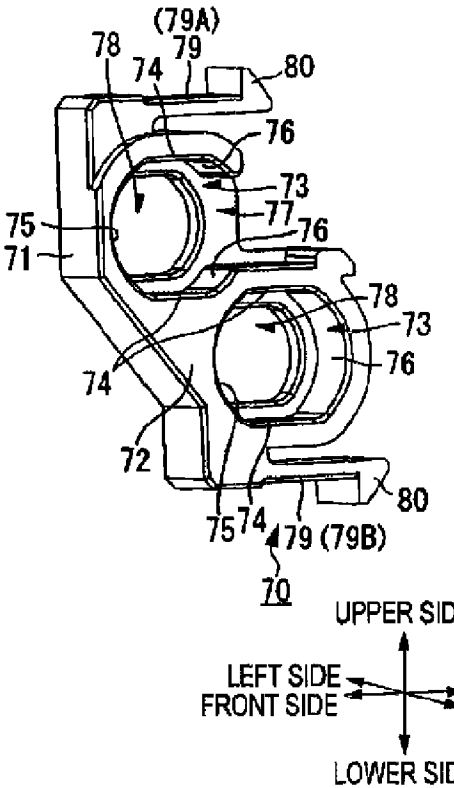
FIG. 6A is a perspective view of a guide member.
Figure 6B:
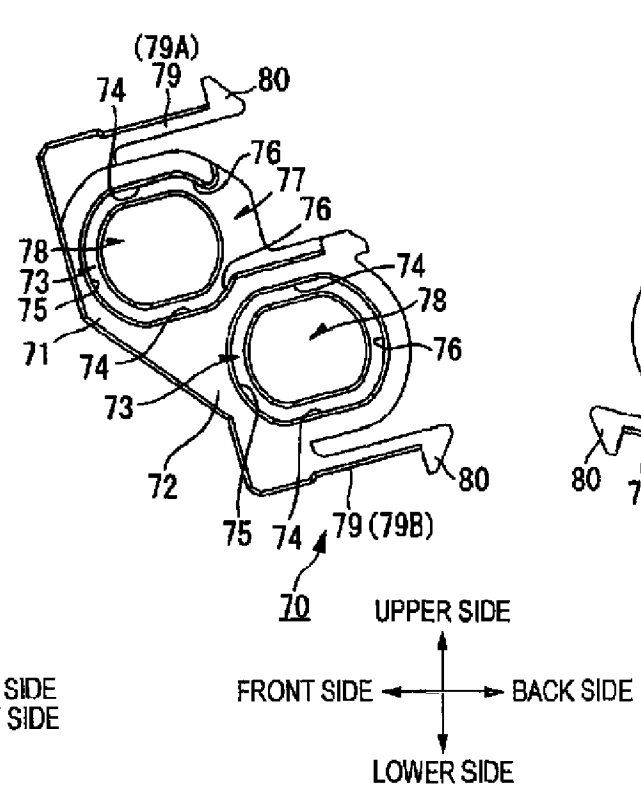
FIG. 6B is a right lateral view of the guide member.
Figure 6C:
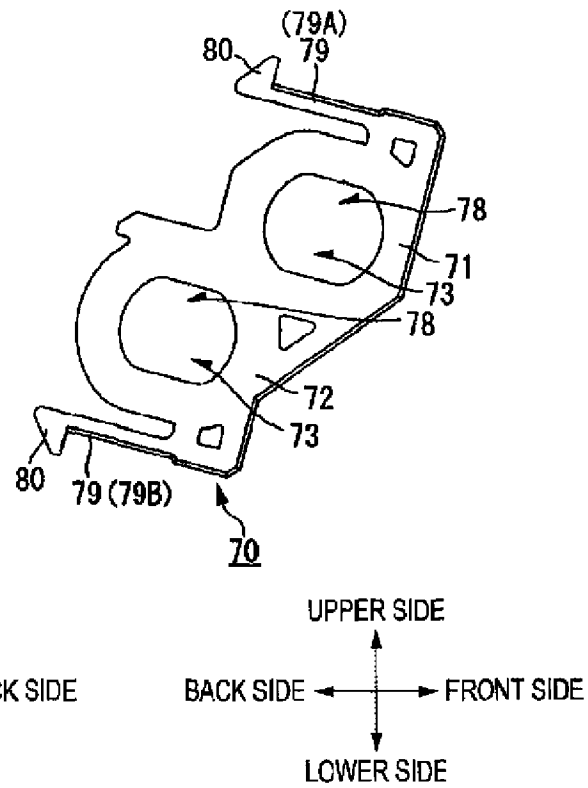
FIG. 6C is a left lateral view of the guide member.

FIGS. 6A to 6C each show the guide member 70.

As shown in FIG. 5, the left side guide member 70 and the right side guide member 70 are aligned in the widthwise direction and are symmetric in this state with respect to a line extending in the up-down direction therebetween. Hereinafter, the guide members 70 will be described referring to FIGS. 6A, 6B and 6C with respect to the left side guide member 70. Incidentally, the position of the guide member 70 in each of FIGS. 6B and 6C is taken when the guide member 70 is attached to the associated bearing member 58 (see FIG. 5).

As shown in FIGS. 6B and 6C, the guide member 70 has a plate-like shape extended longitudinally toward the upper front side (lower back side) and thinned in the widthwise direction as a whole (see also FIG. 6A). The guide member 70 includes an upper front side primary guide part 71 and a lower back side secondary guide part 72.

A widthwise inner surface of the primary guide part 71 (i.e., a frontward surface thereof in FIG. 6B) and that of the secondary guide part 72 are flush with each other (see also FIG. 6A), while a widthwise outward surface of the primary guide part 71 (i.e., a frontward surface thereof in FIG. 6C) and that of the secondary guide part 72 are flush with each other.

As shown in FIG. 6B, the primary and secondary guide parts 71 and 72 each have a substantially rectangular shape extending slightly longitudinally toward the upper back side (lower front side) as seen in the widthwise direction. Most of corners of the primary and secondary guide parts 71 and 72 are rounded at back side portions thereof as seen in the widthwise direction. Further, at the widthwise inner surface of each of the primary and secondary guide parts 71 and 72, there is formed a concave portion 73 dented outward in the widthwise direction (i.e., toward the depth side in FIG. 6B). As seen in the widthwise direction, the concave portion 73 has a substantially elliptical shape extending slightly longitudinally toward the upper back side (lower front side). More specifically, with reference to the concave portion 73 of the secondary guide part 72, the outline of the concave portion 73 as seen in the widthwise direction is defined by: a pair of linear portions 74 located equidistantly in the up-down direction and extended linearly toward the upper back side; a front side circular portion 75 provided between front ends of the pair of linear portions 74 and bulged toward the lower front side in the form of a segment of a circle; and a back side circular portion 76 provided between rear ends of the pair of linear portions 74 and bulged toward the upper back side in the form of a segment of a circle.

Figure 10B:
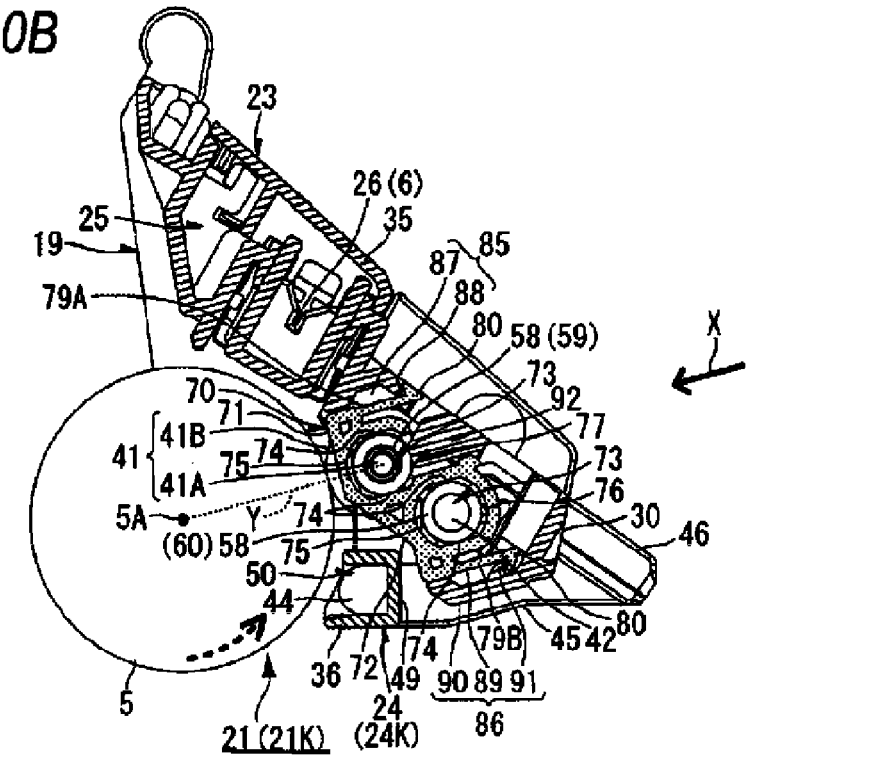
FIG. 10B is a sectional view taken along the chain line indicated by the arrows D-D of FIG. 8.

The longitudinal dimension of the concave portion 73 of the primary guide part 71 is set to be larger than the outer diameter of the primary bearing member 59 of the bearing member 58, and the longitudinal dimension of the concave portion 73 of the secondary guide part 72 is set to be larger than the outer diameter of the secondary bearing member 60 of the bearing member 58 (see FIGS. 9A and 10B). Further, the distance between the pair of linear portions 74 in the concave portion 73 of the primary guide part 71 is set to be substantially equal to (or slightly larger than) the outer diameter of the primary bearing member 59. Furthermore, the distance between the pair of linear portions 74 in the concave portion 73 of the secondary guide part 72 is set to be substantially equal to (or slightly larger than) the outer diameter of the secondary bearing member 60 (see FIGS. 9A and 10B).

Moreover, at a rear end portion of the primary guide part 71, there is formed a cut-out 77 by which only a region corresponding to the concave portion 73 in the widthwise direction (i.e., the direction perpendicular to the plane of FIG. 6B) is cut out (the cut-out 77 does not pass through the rear end portion of the primary guide part 71 in the widthwise direction). The concave portion 73 of the primary guide part 71 is exposed to the back side through the cut-out 77. In other words, strictly speaking, the outline of the concave portion 73 of the primary guide part 71 as seen in the widthwise direction does not have a substantially elliptical shape unlike that of the concave portion 73 of the secondary guide part 72, but has a substantially "C" shape that is cut between the back side circular portions 76.

Further, at a bottom portion (widthwise outward portion) of the concave portion 73 of each of the primary and secondary guide parts 71 and 72, there is formed an insertion hole 78 passing through the bottom portion in the widthwise direction. The insertion hole 78 is similar in shape to the concave portion 73 (the concave portion 73 of the secondary guide part 72, to be exact) as seen in the widthwise direction and has an elliptical shape slightly smaller than that of the concave portion 73.

Furthermore, an engagement portion 79 extending linearly toward the upper back side is provided at upper front side and lower front side end portions of the primary and secondary guide parts 71 and 72. The engagement portion 79 provided at the primary guide part 71 (which will be referred to as a "first engagement portion 79A") is extended toward the upper back side so as to be upwardly away from the primary guide part 71. The engagement portion 79 provided at the secondary guide part 72 (which will be referred to as a "second engagement portion 79B") is extended toward the upper back side so as to be downwardly away from the secondary guide part 72. A hook-like claw 80 is integrally provided at a rear end portion of each engagement portion 79. The claw 80 of the first engagement portion 79A is protruded toward the upper front side, and the claw 80 of the second engagement portion 79B is protruded toward the lower back side.

As shown in FIG. 5, the above-described guide member 70 is attached to each of the right and left bearing members 58.

More specifically, in this state, the concave portions 73 (see FIG. 6A) of both of the primary and secondary guide parts 71 and 72 are facing inward in the widthwise direction in the guide member 70 attached to each bearing member 58.

Moreover, a portion of the primary bearing member 59 of the associated bearing member 58, located outwardly of the connecting portion 61 in the widthwise direction, is freely fitted to the concave portion 73 of the primary guide part 71 (see FIG. 6A) from inside in the widthwise direction. In this state, a back side outer peripheral face of the portion of the primary bearing member 59, freely fitted to the concave portion 73, is exposed to the back side through the cut-out 77 of the guide member 70 (see also FIG. 6B). A portion of the secondary bearing member 60 of the associated bearing member 58, located outwardly of the connecting portion 61 in the widthwise direction, is freely fitted to the concave portion 73 of the secondary guide part 72 (see FIG. 6A) from inside in the widthwise direction. In this state, each of the primary and secondary bearing members 59 and 60 can be slid along the longitudinal direction of the associated (freely fitted) concave portion 73 (see FIGS. 6A, 6B and 6C).

Further, a portion of the shaft portion 41A of the primary roller 41, located outwardly of the primary bearing member 59 of the associated bearing member 58 in the widthwise direction, is freely fitted to the insertion hole 78 of the primary guide part 71 (see FIG. 6A). Furthermore, a portion of the secondary roller 42, located outwardly of the secondary bearing member 60 of the associated bearing member 58 in the widthwise direction, is freely fitted to the insertion hole 78 (see FIG. 6A) of the secondary guide part 72 (see also FIG. 6A). In this state, each of the shaft portion 41A and the secondary roller 42 can be slid along the longitudinal direction of the associated (freely fitted) insertion hole 78 (see FIGS. 6A, 6B and 6C).

The right end part of the shaft portion 41A of the primary roller 41 is protruded rightward through the insertion hole 78 (see FIG. 6A) of the right side guide member 70 (primary guide part 71), and the left end part of the shaft portion 41A of the primary roller 41 is protruded leftward through the insertion hole 78 of the left side guide member 70 (primary guide part 71). A cylindrical collar 69 is externally fitted to the right end part of the shaft portion 41A from the right side, and the primary gear 56 is assembled to the left end part of the shaft portion 41A. The collar 69 is electrically conductive.

The right end part of the secondary roller 42 is protruded rightward through the insertion hole 78 (see FIG. 6A) of the right side guide member 70 (secondary guide part 72), and the left end part of the secondary roller 42 is protruded leftward through the insertion hole 78 of the left side guide member 70 (secondary guide part 72). A collar 69 is externally fitted to the right end part of the secondary roller 42 from the right side similarly to the right end part of the shaft portion 41A, and the secondary gear 57 is assembled to the left end part of the secondary roller 42.

The collar 69 is externally fitted to the right end part of each of the shaft portion 41A and the secondary roller 42 from the right side. Therefore, the positioning of the right side guide member 70 is determined with respect to the widthwise direction, and the guide member 70 is thus prevented from being deviated to the right side. The right end face of each of the shaft portion 41A and the secondary roller 42 is exposed to the right side through the associated collar 69. Moreover, the associated gear (either the primary gear 56 or the secondary gear 57) is attached to the left end part of each of the shaft portion 41A and the secondary roller 42. Therefore, the positioning of the left side guide member 70 is determined with respect to the widthwise direction, and the guide member 70 is thus prevented from being deviated to the left side.

In the state where the guide member 70 is attached to each of the right and left bearing members 58 as described above, each bearing member 58 can be moved relatively with respect to the guide member 70 attached thereto by sliding each bearing member 58 along the longitudinal direction of the concave portion 73 (i.e., the direction parallel to the linear portions 74 extending toward the upper back side in the concave portion 73 (see FIG. 6B)). Accordingly, the primary and secondary rollers 41 and 42 supported by the bearing members 58 can also be slid together with the bearing members 58.

In addition, referring to FIGS. 4A and 4B, the second frame 36 is fixed to the right and left bearing members 58 as described above. Therefore, the entire second unit 24 can be moved relatively with respect to the right and left guide members 70 in an integrated manner by sliding the second unit 24 along the longitudinal direction of the concave portion 73 (see FIGS. 6A, 6B and 6C).

Next, the support relationship between the first and second units 23 and 24 will be described. Prior to this description, the first unit 23 and the first frame 35 will be further described.

Figure 7A:
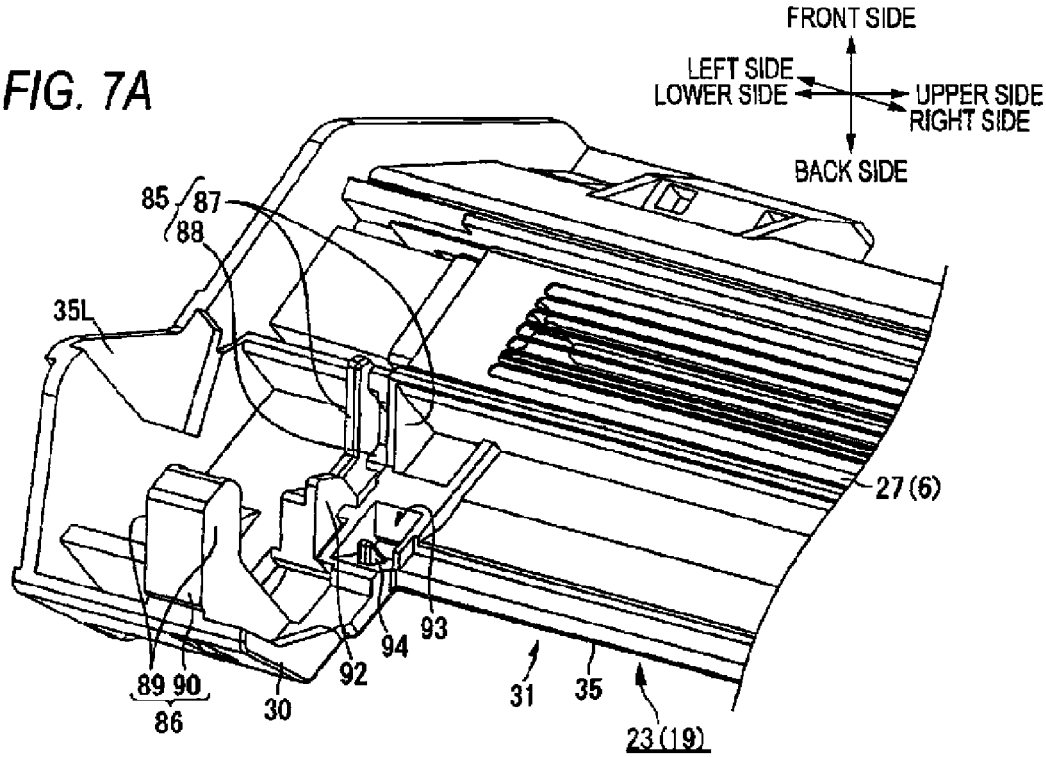
FIG. 7A is a perspective view of the periphery of a left end portion of a first frame for the sub-unit of the photosensitive unit, as seen from below.
Figure 7B:
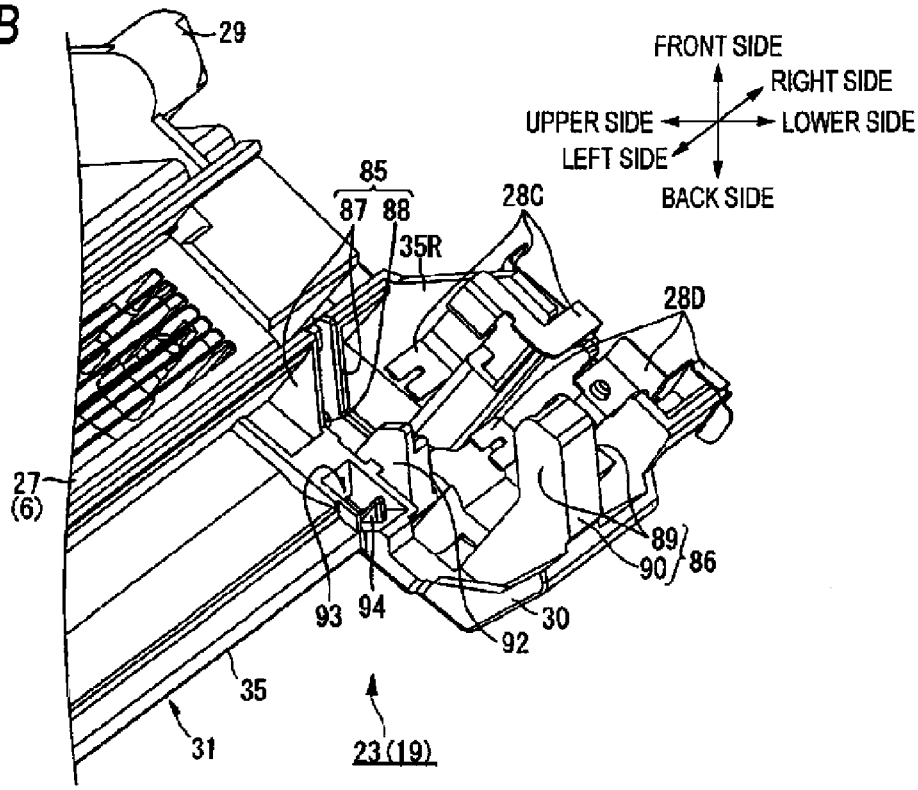
FIG. 7B is a perspective view of the periphery of a right end portion of the first frame, as seen from below.

Referring to FIGS. 7A and 7B, a front holder 85 and a rear holder 86 are integrally provided on a lower face of each of right and left end portions of the first frame 35 (more specifically, portions of the first frame 35 corresponding to the protrusive portions 30) such that the front and rear holders 85 and 86 aligned at a distance in the front-back direction.

The front holder 85 integrally includes: a pair of plates (which will be referred to as "front plates 87") protruded toward the lower front side from the lower face of the first frame 35, with a gap provided between the front plates 87 in the widthwise direction; and a claw 88 provided between the pair of front plates 87 and protruded toward the lower back side (see also FIGS. 9A and 10B). Each front plate 87 has a substantially triangle shape tapered toward the lower front side as seen in the widthwise direction.

The rear holder 86 integrally includes: a pair of plates (which will be referred to as "rear plates 89") protruded toward the lower front side from the lower face of the first frame 35, with a gap provided between the rear plates 89 in the widthwise direction; a closing member 90 for closing a space between rear ends of the pair of rear plates 89 and a space between lower ends of the pair of rear plates 89; and an upwardly protruding claw 91 (see FIGS. 9A and 10B) provided at a surface of the closing member 90 facing toward the upper front side (this surface does not shown in FIGS. 7A and 7B). Each rear plate 89 has a substantially "J" shape bent downward toward the front side as seen in the widthwise direction.

Further, a convex portion 92 (one example of a restricting part) protruding toward the front side is integrally provided on the lower face of each of right and left end portions of the first frame 35 between the front and rear holders 85 and 86 (see also FIGS. 9A and 10B). Furthermore, at the lower face of the first frame 35, a concave portion 93 is provided at a position adjoining to the convex portion 92 from inside in the widthwise direction. A protrusive portion 94 protruded toward the front side is integrally provided at a portion, which defines the concave portion 93, of the first frame 35 The protrusive portion 94 has a substantially triangle shape tapered toward the front side as seen in the widthwise direction and is thin in the widthwise direction.

In the exemplary embodiment, as shown in FIG. 7B, at a left side face of a right wall 35R of the first frame 35, each of the third and fourth electrodes 28C and 28D is partially exposed.

As shown in FIGS. 3A and 3B, the second unit 24 (24K) is supported by the first unit 23 having the first frame 35 described above. The second unit 24 is assembled to the first unit 23 from the back side.

In this state, parts of the second unit 24, located leftwardly of the second frame 36 (e.g., the left side holding part 51, bearing member 58, guide member 70, coil spring 64, primary gear 56 and secondary gear 57 (see FIGS. 4A and 4B)), are located below the left end portion of the first frame 35 (i.e., a portion of the first frame 35, corresponding to the left side protrusive portion 30).

Moreover, parts of the second unit 24, located rightwardly of the second frame 36 (e.g., the right side holding part 51, bearing member 58, guide member 70, coil spring 64, and right end portion of the light guide member 44 (see FIGS. 4A and 4B)), are located below the right end portion of the first frame 35 (i.e., a portion of the first frame 35, corresponding to the right side protrusive portion 30).

In this case, the collar 69 (see FIG. 5), externally fitted to the right end part of the shaft portion. 41A of the primary roller 41 supported by the pair of bearing members 58, is brought into contact with the third electrode 28C (see FIG. 7B) exposed to the left side face of the right wall 35R of the first frame 35. Thus, the primary roller 41 is connected to the third electrode 28C via the electrically conductive collar 69. Furthermore, the collar 69 (see FIG. 5), externally fitted to the right end part of the secondary roller 42 supported by the pair of bearing members 58, is brought into contact with the fourth electrode 28D (see FIG. 7B) exposed to the left side face of the right wall 35R of the first frame 35. Thus, the secondary roller 42 is connected to the fourth electrode 28D via the collar 69.

In the second unit 24, the second frame 36 is accommodated in the space (i.e., the cut-out 31) between the right and left protrusive portions 30 of the first frame 35 and is exposed to the upper back side through the cut-out 31 (see FIG. 3A).

Figure 8:
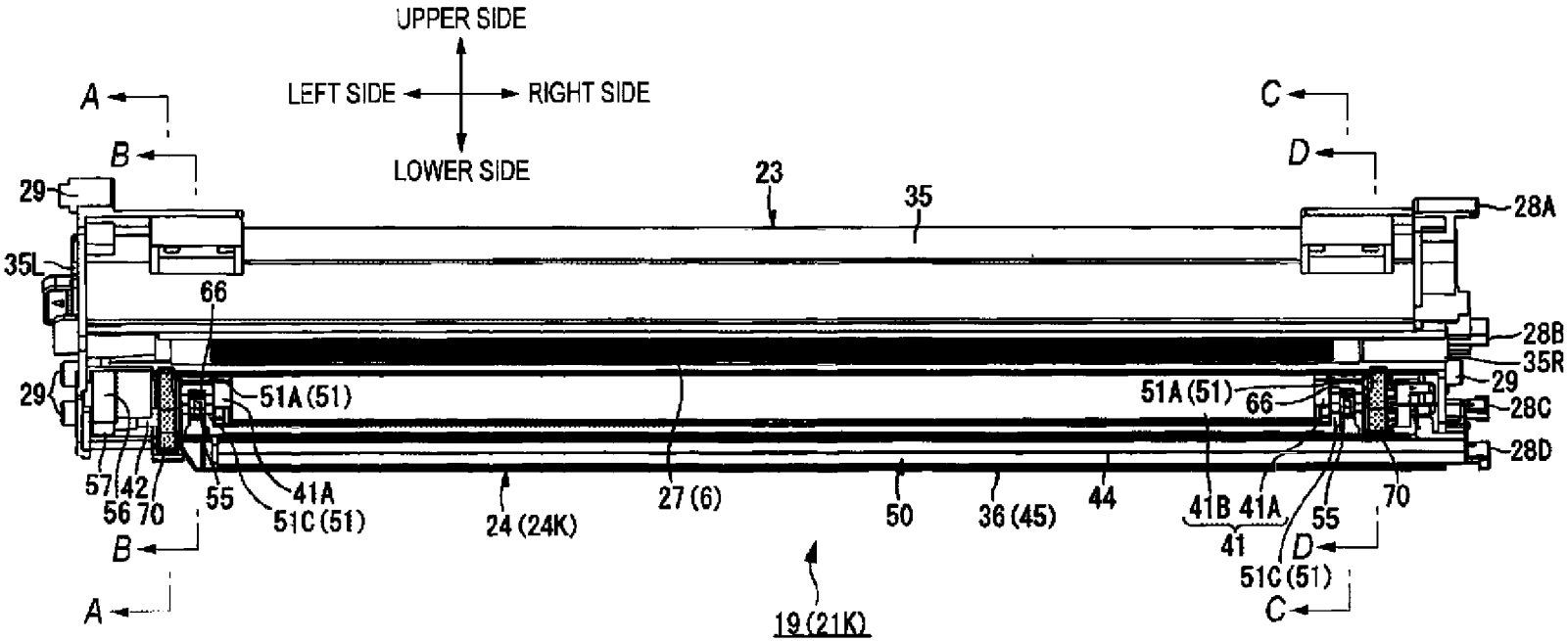
FIG. 8 is a front view of the black photosensitive unit, from which a photosensitive drum is removed.

FIG. 8 is a front view of the black photosensitive unit 21K, from which the photosensitive drum 5 is removed. FIGS. 9A, 9B, 10A and 10B each show a sectional view of the black photosensitive unit 21K taken along a chain line indicated by arrows of FIG. 8. Incidentally, in each of FIGS. 9A, 9B, 10A and 10B, the photosensitive drum 5 is also illustrated in addition to the black photosensitive unit 21K.

Next, referring to FIGS. 9A, 9B, 10A and 10B, the support relationship between the first and second units 23 and 24 will be further described. Here, FIGS. 9A and 9B each show a sectional view of the periphery of a left end portion of the photosensitive unit 21K, and FIGS. 10A and 10B each show a sectional view of the periphery of a right end portion of the photosensitive unit 21K.

Referring to FIGS. 9A and 10B, the right and left guide members 70 are each held by both of the front and rear holders 85 and 86 (see FIGS. 7A and 7B) located at the same side in the widthwise direction in the first frame 35.

More specifically, an upper end part of the guide member 70 is sandwiched between the pair of front plates 87 of the front holder 85 (see FIGS. 7A and 7B), and a lower end part of the guide member 70 is sandwiched between the pair of rear plates 89 of the rear holder 86 (see FIGS. 7A and 7B). Moreover, in the guide member 70, the claw 80 of the upper side first engagement portion 79A is engaged with the claw 88 of the front holder 85 from the lower back side, and the claw 80 of the lower side second engagement portion 79B is engaged with the claw 91 of the rear holder 86 from the upper back side.

Thus, the right and left guide members 70 are each held by the front and rear holders 85 and 86 located at the same side in the widthwise direction. Therefore, the right and left guide members 70 are fixed so as not to be able to move relatively with respect to the first frame 35.

As described above, the guide member 70 is attached to each of the right and left bearing members 58 to which the second frame 36 of the second unit 24 is fixed (see FIGS. 4A and 4B). Therefore, the second frame 36 (i.e., the entire second unit 24) is supported by the first frame 35 (first unit 23) via the right and left guide members 70.

Furthermore, the entire second unit 24 is slid and is thus allowed to move relatively with respect to the right and left guide members 70 in an integrated manner as described above. Therefore, the second unit 24 is slidably supported by the first unit 23. The sliding direction of the second unit 24 coincides with the longitudinal direction of the concave portion 73 of the guide member 70 (i.e., the direction parallel to the linear portions 74 extending toward the upper back side in the concave portion 73 (see also FIG. 6B)). In the exemplary embodiment, in the sliding direction of the second unit 24, the direction extending toward the front side (see the thick solid line with an arrow) will be referred to as a "pressing direction X".

In this state, the convex portion 92 provided between the front and rear holders 85 and 86 in the first frame 35 as described above is fitted from the back side into the cut-out 77 (see also FIGS. 6A and 6B) of the guide member 70 located at the same side in the widthwise direction. Further, the convex portion 92 is opposed to or abutted against the back side outer peripheral face of the primary bearing member 59 of the bearing member 58 freely fitted to the concave portion 73 of the primary guide part 71 of the guide member 70 (i.e., a region of the back side outer peripheral face of the primary bearing member 59, exposed to the back side through the cut-out 77) from the back side (from the upstream side in the pressing direction X). When the convex portion 92 is opposed to the back side outer peripheral face of the primary bearing member 59, a slight gap is provided therebetween.

Thus, each of the right and left primary bearing members 59 will not be deviated from a position, in which each of the right and left primary bearing members abuts against the convex portion 92, toward the upstream side in the pressing direction X. In other words, the convex portion 92 is provided at the upstream side in the pressing direction X with respect to the widthwise end portions of the primary roller 41 so as to restrict the movement of the widthwise end portions of the primary roller 41 toward the upstream side in the pressing direction X.

Moreover, referring to FIGS. 9B and 10A, a rear end of the coil spring 64 attached to the back side outer peripheral face of each of the right and left primary bearing members 59 is externally fitted from the front side to the protrusive portion 94 located at the same side in the widthwise direction in the first frame 35. In this state, the coil spring 64 is extending longitudinally along the pressing direction X and is compressed along the pressing direction X.

Thus, the coil spring 64 will elongate toward the front side (toward the downstream side in the pressing direction X). In this state, the coil spring 64 presses the primary bearing member 59 toward the downstream side in the pressing direction X. Accordingly, the pair of right and left bearing members 58, the primary roller 41 supported by the primary bearing members 59 of the bearing members 58, and the secondary roller 42 supported by the secondary bearing members 60 of the bearing members 58 are pressed in the pressing direction X (toward the downstream side in the pressing direction X) in an integrated manner. In accordance therewith, the entire second unit 24 is pressed in the pressing direction X. In this state, a front side outer peripheral face of the primary roller 41 (roller portion 41B) is exposed to the front side not only in regard to the second unit 24 but also in regard to the entire sub-unit 19.

In the state where such a support relationship is established between the first and second units 23 and 24, the sub-unit 19 including the first and second units 23 and 24 is located so as to be opposed to the associated photosensitive drum 5 from the upper back side as described above.

In this state, at the front side outer peripheral face of the roller portion 41B, the primary roller 41 is brought into contact with the back side outer peripheral face of the photosensitive drum 5 across the entire widthwise direction thereof from the back side.

In the exemplary embodiment, as seen in the widthwise direction, a straight line (i.e., a reference line Y indicated by the dotted line), connecting a circular center (shaft portion 41A) of the primary roller 41 with a circular center 5A of the photosensitive drum 5, is located on an extension of a line of action of the pressing force applied by the coil spring 64 (see the arrow with the reference character "X") that presses the primary bearing member 59 toward the downstream side in the pressing direction X.

Therefore, the primary roller 41 is brought into contact with the photosensitive drum 5 toward the circular center 5A of the photosensitive drum 5, and the pair of coil springs 64 presses the pair of primary bearing members 59 (i.e., the primary roller 41) toward the circular center 5A of the photosensitive drum 5 along the pressing direction X. Thus, the pressing force is perpendicularly applied from the primary roller 41 to the photosensitive drum 5.

Referring to FIGS. 9A and 10B, in each of the pair of guide members 70, the longitudinal direction of the concave portion 73 of the primary guide part 71, to which the associated primary bearing member 59 is freely fitted, and the longitudinal direction of the concave portion 73 of the secondary guide part 72, to which the associated secondary bearing member 60 is freely fitted, are both parallel to the pressing direction X.

Hence, with the primary bearing member 59 pressed in the pressing direction X by the coil spring 64 (see FIGS. 9B and 10A), in each guide member 70, the concave portion 73 of the primary guide part 71 guides the primary bearing member 59 in the pressing direction X, and the concave portion 73 of the secondary guide part 72 guides the secondary bearing member 60 in the pressing direction X.

Furthermore, a gear is provided at a left end portion of the photosensitive drum 5 (see FIGS. 2A and 2B). This gear will be referred to as a drum gear 68 (one example of a first gear). The drum gear 68 has a substantially cylindrical shape with a center axis extending in the widthwise direction. Gear teeth are formed at an outer peripheral face of the drum gear 68. In the exemplary embodiment, the primary gear 56 (see FIG. 5) provided at the left end portion of the primary roller 41 intermeshes the drum gear 68 from the back side (not shown).

Moreover, as shown in FIGS. 10A and 10B, at a position below the primary roller 41, the front face of the light guide member 44, bulged toward the front side in the form of a segment of a circle, is opposed to a lower back side outer peripheral face of the photosensitive drum 5 across the entire widthwise direction thereof from the back side at a given distance. In the exemplary embodiment, the photosensitive drum 5 is rotated in a counterclockwise direction (see the thick dotted line with an arrow) as seen from the right side. Therefore, with respect to the rotation direction of the photosensitive drum 5, the lower back side outer peripheral face of the photosensitive drum 5, opposed to the light guide member 44, is a region of the outer peripheral face of the photosensitive drum 5, which is immediately before coming into contact with the primary roller 41. Further, the right end portion of the light guide member 44 (see FIG. 3B) is exposed to the right side through the Tight side plate 22R of the unit frame 20 of the tandem photosensitive unit 4 (see FIG. 1) and is opposed to a light source (not shown) provided in the body casing 2 (see FIG. 1) in this state.

(2-2) Second Units for Colors other than Black

The second units 24Y, 24M and 24C for colors other than black will be described below.

Figure 11A:
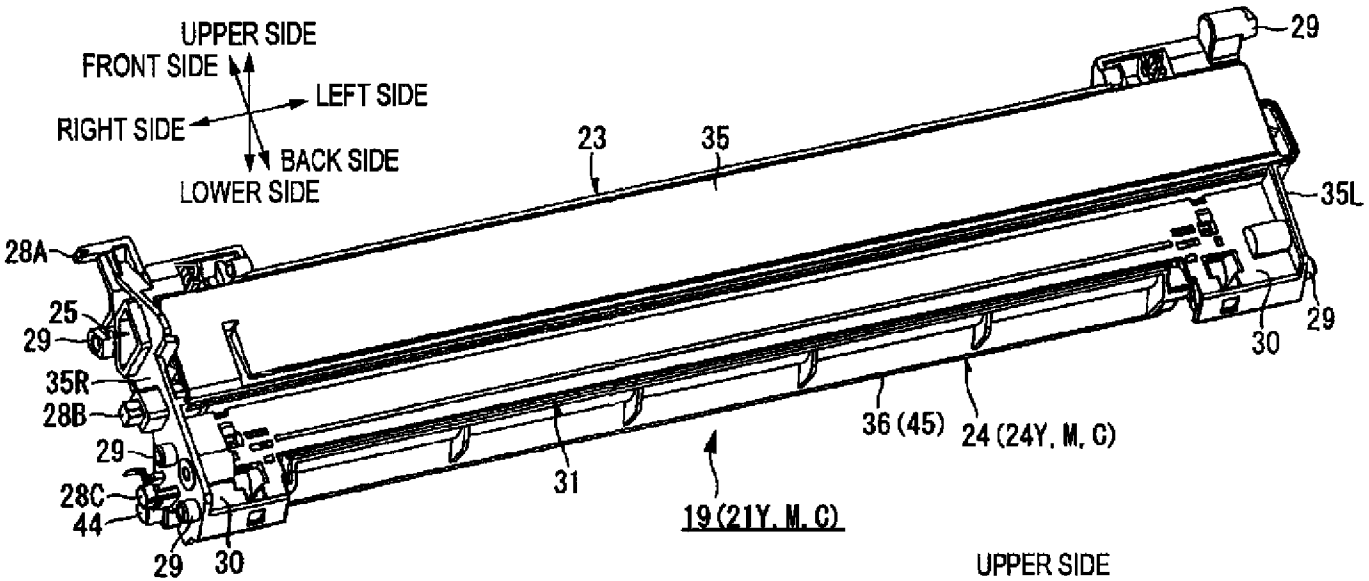
FIG. 11A is a perspective view of the photosensitive unit (sub-unit) for a color other than black, from which a photosensitive drum is removed and which is seen from the upper right rear.
Figure 11B:
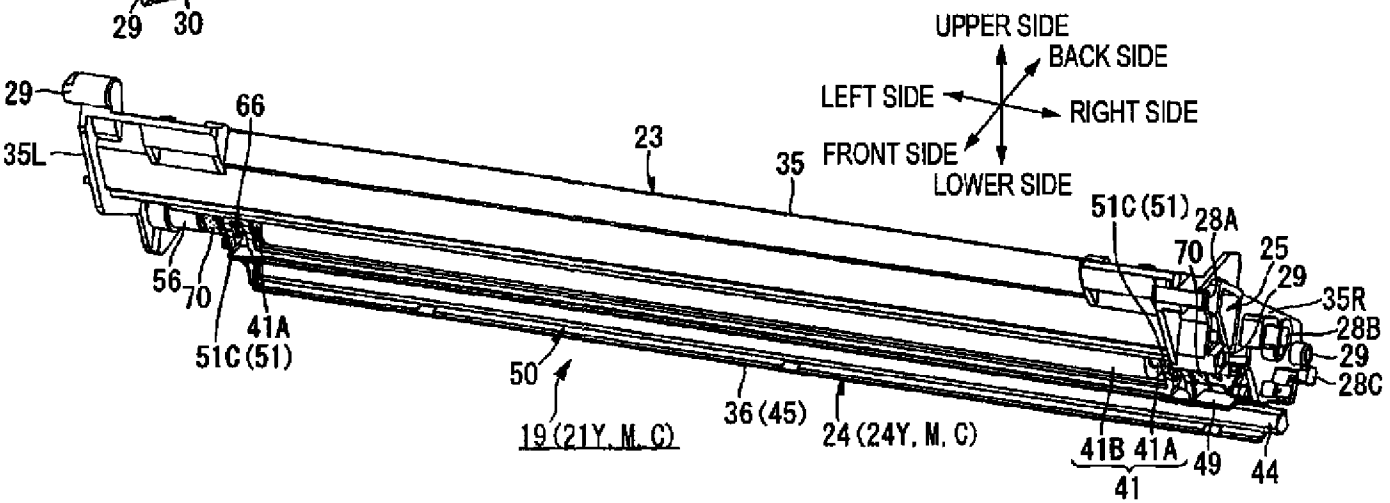
FIG. 11B is a perspective view of the photosensitive unit (sub-unit) for a color other than black, from which a photosensitive drum is removed and which is seen from the right front.
Figures 12A, 12B:
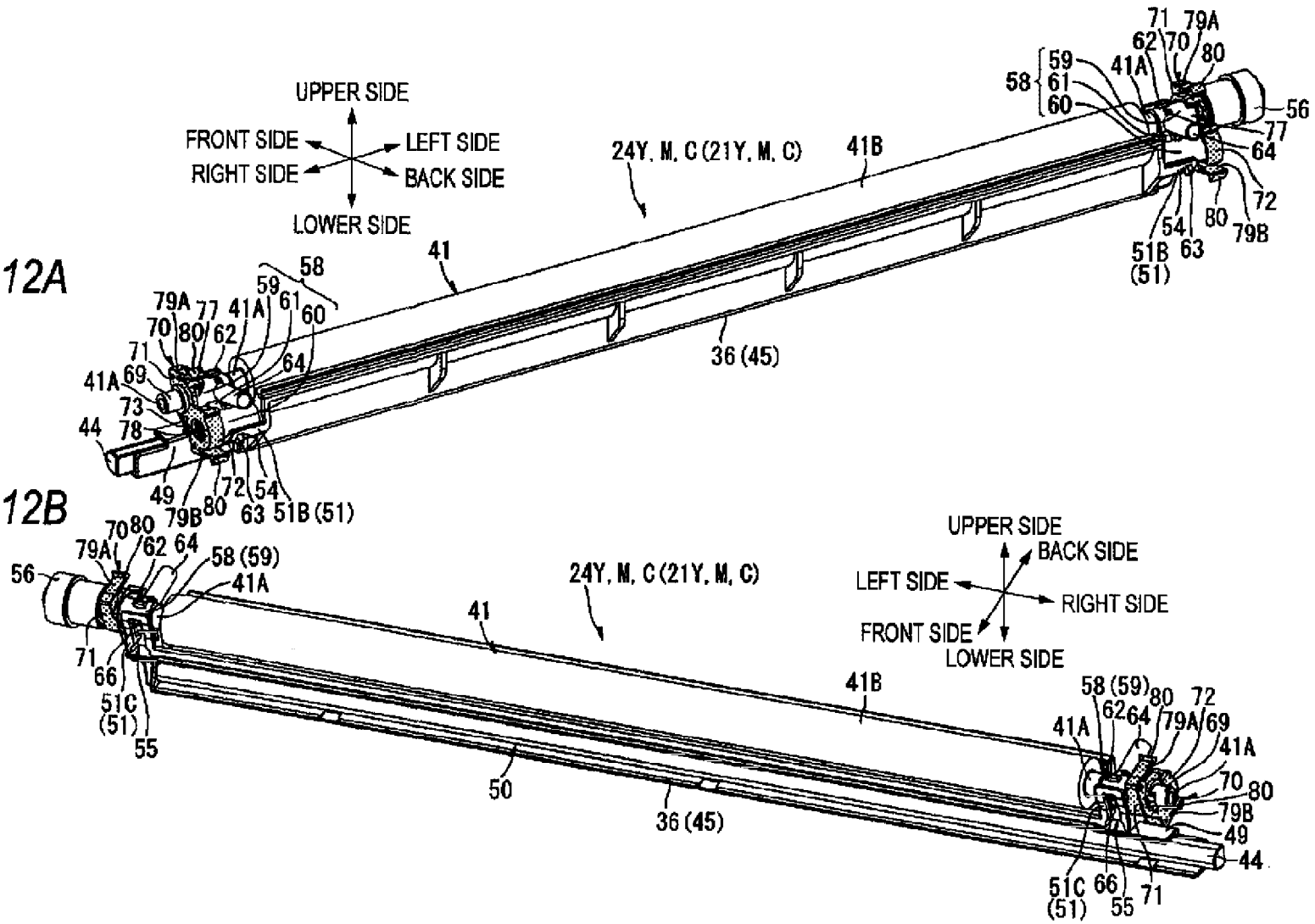
FIG. 12A is a perspective view of a second unit for a color other than black, as seen from the upper right rear.
FIG. 12B is a perspective view of the second unit for a color other than black, as seen from the right front.

Here, FIGS. 11A and 11B are schematic perspective views of each of the photosensitive units 21Y, 21M and 21C (sub-units 19) for a color other than black, and FIGS. 12A and 12B are perspective views of each of the second units 24Y, 24M and 24C for colors other than black included in the photosensitive units 21Y, 21M and 21C.

Referring to FIG. 2A, the black second unit 24K (photosensitive unit 21K) includes both of the primary and secondary rollers 41 and 42, the scraping member 43 and the storage chamber 47, as described above.

However, as shown in FIG. 2B, the second units 24Y, 24M and 24C (photosensitive units 21Y, 21M and 21C) for colors other than black each include only the primary roller 41 instead of including both of the primary and secondary rollers 41 and 42. Further, in relation thereto, each of the second units 24Y, 24M and 24C does not include the scraping member 43 and the storage chamber 47.

Specifically, the second frame 36 of each of the second units 24Y, 24M and 24C includes only the lower frame 45 instead of including both of the upper and lower frames 45 and 46. However, the lower frame 45 of each of the second units 24Y, 24M and 24C is different in shape from the lower frame 45 of the second unit 24K (see FIG. 2A). The cross section of the lower frame 45 of each of the second units 24Y, 24M and 24C as seen in the widthwise direction is extended substantially horizontally toward the back side, bent at a substantially right angle, extended substantially perpendicularly toward the upper side, and then further extended toward the upper side while being curved along a lower back side outer peripheral face of the primary roller 41.

As described above, each of the second units 24Y, 24M and 24C does not include the secondary roller 42, the scraping member 43 and the storage chamber 47. Therefore, the second units 24Y, 24M and 24C are each reduced in size accordingly in the front-back direction, specifically, as compared with the second unit 24K. Therefore, also in regard to the entire sub-unit 19, the sub-unit 19 of each of the photosensitive units 21Y, 21M and 21C is reduced in size in the front-back direction as compared with the sub-unit 19 of the photosensitive unit 21K (see also FIGS. 3A, 3B, 11A and 11B).

In the exemplary embodiment, referring to FIGS. 12A and 12B, each of the second units 24K, 24Y, 24M and 24C has the similar bearing members 58 and guide members 70 described above (see also FIGS. 4A and 4B).

However, the second units 24Y, 24M and 24C each include only the primary roller 41 instead of including both of the primary and secondary rollers 41 and 42 as described above. Therefore, in the second unit 24 of each of the second units 24Y, 24M and 24C, the primary bearing members 59 of the pair of right and left bearing members 58 rotatably support the widthwise end portions of the primary roller 41, but the secondary hearing members 60 of the pair of right and left bearing members 58 do not support anything.

Further, in the right and left guide members 70 of the second unit 24 of each of the second units 24Y, 24M and 24C, a portion of the primary bearing member 59 of the associated bearing member 58, located outwardly of the connecting portion 61 in the widthwise direction, is freely fitted to the concave portion 73 of the primary guide part 71 (see FIG. 6A) from inside in the widthwise direction. Furthermore, a portion of the secondary bearing member 60 of the associated bearing member 58, located outwardly of the connecting portion 61 in the widthwise direction, is freely fitted to the concave portion 73 of the secondary guide part 72 (see FIG. 6A) from inside in the widthwise direction.

Moreover, a portion of the shaft portion 41A of the primary roller 41, located outwardly of the primary bearing member 59 of the associated bearing member 58 in the widthwise direction, is freely fitted to the insertion hole 78 of the primary guide part 71 (see FIG. 6A).

However, nothing is fitted to the insertion hole 78 of the secondary guide part 72 (see also FIG. 6A).

Regarding the pair of holding parts 51 described above, each of the holding parts 51 in the second units 24Y, 24M and 24C includes the second and third holding portions 51B and 51C, but includes no first holding portion 51A (see FIGS. 4A and 4B). Unlike the second unit 24K, in each of the second units 24Y, 24M and 24C, the second holding portions 51B is integrally provided at widthwise end portions of the lower frame 45.

Therefore, in each of the holding parts 51 of the second units 24Y, 24M and 24C, a substantially half of a widthwise inner portion of the bearing member 58 located at the same side in the widthwise direction is fitted between the second and third holding portions 51B and 51C (see both of FIGS. 12A and 12B), with the second frame 36 (lower frame 45) fixed to the right and left bearing members 58.

In this state, in each bearing member 58, the second convex portion 63 (see also FIG. 5) of the secondary bearing member 60 is fitted from the front side into the second through hole 54 of the second holding portion 51B located at the same side in the widthwise direction and is thus engaged with the second holding portion 51B (see FIG. 12A). Further, the third convex portion 66 of the primary bearing member 59 is fitted from the back side into the third through hole 55 of the third holding portion 51C located at the same side in the widthwise direction and is thus engaged with the third holding portion 51C (see FIG. 12B). Thus, the second frame 36 (lower frame 45) is fixed to the right and left bearing members 58 via the respective holding parts 51. On the other hand, the first convex portion 62 of the primary bearing member 59 is not engaged with anything.

As for parts other than those described above, the second unit 24K (see FIG. 2A) is substantially similar in structure to the second units 24Y, 24M and 24C (see FIG. 2B).

(2-3) Operations in Photosensitive Unit

Next, regarding operations in the photosensitive unit 21, operations in the photosensitive unit 21K for black will be mainly described.

In the exemplary embodiment, referring to FIG. 2A, the photosensitive drum 5 is rotated in the counterclockwise direction as seen from the right at the time of image formation as described above. Therefore, a driving force resulting from the rotation of the photosensitive drum 5 is transmitted via the drum gear 68 to the primary gear 56 (see FIG. 3B) of the primary roller 41 intermeshing the drum gear 68. Thus, the primary gear 56 causes the primary roller 41 to be rotated in a clockwise direction as seen from the right side. Further, the secondary gear 57 (see FIG. 5) of the secondary roller 42 intermeshes the primary gear 56. Therefore, the secondary gear 57 rotates the secondary roller 42 in the counterclockwise direction as seen from the right side by the driving force transmitted from the primary gear 56.

As described above, at the time of image formation, in each photosensitive unit 21, the outer peripheral face of the photosensitive drum 5 is uniformly electrically charged by the charger 6 and is then exposed to a laser beam emitted from the scanner unit 9 (see FIG. 1). Thus, an electrostatic latent image is formed on the outer peripheral face of the photosensitive drum 5. This electrostatic latent image is visualized and converted into a toner image by the toner held at the outer peripheral face of the developing roller 7, and the toner image is transferred to the sheet S (see FIG. 1). In this case, the lower side outer peripheral face of the photosensitive drum 5 is brought into contact with the sheet S.

Thereafter, a region of the outer peripheral face of the photosensitive drum 5, which has been brought into contact with the sheet S and from which the toner image has been transferred to the sheet S, is first opposed to the light guide member 44 from the front in accordance with the rotation of the photosensitive drum 5. In this case, the light source (not shown) emits light, and the light emitted from the light source travels toward the left side (i.e., the depth side in FIG. 2A) along the widthwise direction (i.e., the direction perpendicular to the plane of FIG. 2A). Then, the light enters the inside of the light guide member 44 from a right end face of the light guide member 44 and subsequently travels toward the left side along the widthwise direction inside the light guide member 44.

In the exemplary embodiment, in the light guide member 44 accommodated in the concave portion 50 as described above, the upper, lower and rear faces of the light guide member 44 are covered, while the front face of the light guide member 44 is exposed to the front side through the concave portion 50. Therefore, part of the light traveling toward the left side inside the light guide member 44 leaks to the front side through the front face of the light guide member 44. Furthermore, in the middle of the travel, another part of the light traveling toward the left side inside the light guide member 44 is reflected by the regions of the front end portion and extended portion 49 of the lower frame 45 by which the concave portion 50 is defined, and travels toward the front side. The lower frame 45 and the extended portion 49 (i.e., the second frame 36) are made of, for example, a white-color material so that the light can be efficiently reflected.

The light leaked to the front side through the front face of the light guide member 44 in the middle of the travel in this manner and the light traveling toward the front side by the reflection are merged with each other. The merged light subsequently travels toward the front side and is applied to the outer peripheral face of the photosensitive drum 5 (i.e., a region of the outer peripheral face, which is opposed to the light guide member 44 and is immediately before coming into contact with the primary roller 41) across the entire widthwise direction thereof. Thus, at the region to which the light is applied, the outer peripheral face of the photosensitive drum 5 is exposed to the light across the entire widthwise direction thereof, and residual electric charges at the exposed region is removed. In other words, the light guide member 44 guides the light for removing electric charges at the outer peripheral face of the photosensitive drum 5, so that the light is guided to the region of the outer peripheral face of the photosensitive drum 5, which is immediately before coming into contact with the primary roller 41.

Furthermore, the region of the outer peripheral face of the photosensitive drum 5, from which the residual electric charges have been removed in this manner, is then brought into contact with the primary roller 41 that is being rotated due to the rotation of the photosensitive drum 5.

At that time, a primary cleaning bias is applied to the primary roller 41 via the third electrode 28C (see FIGS. 3A and 3B) from the power source (not shown) of the body casing 2.

In the exemplary embodiment, during the transfer of the toner image to the sheet S from the photosensitive drum 5, paper dust might be adhered to the outer peripheral face of the photosensitive drum 5 from the sheet S. In addition, transfer residual toner might remain on the outer peripheral face of the photosensitive drum 5 after the transfer of the toner image to the sheet S.

Among the foreign substances such as paper dust and transfer residual toner on the surface (outer peripheral face) of the photosensitive drum 5, the transfer residual toner is transferred to the outer peripheral face of the primary roller 41 (roller portion 41B) by the primary cleaning bias (which is a primary cleaning bias lower than a surface potential of the photosensitive drum 5 in this case) through a contact position between the photosensitive drum 5 and the primary roller 41, and the transfer residual toner is temporarily captured by the primary roller 41.

Further, at the time when no toner image is transferred to the sheet S (e.g., during a period of time between the transfer of a toner image to the previous sheet S and the transfer of a toner image to the subsequent sheet S when image formation is continuously performed on the two sheets S), the primary cleaning bias higher than the surface potential of the photosensitive drum 5 is applied to the primary roller 41.

Then, the transfer residual toner temporarily captured by the primary roller 41 is returned to the photosensitive drum 5 from the primary roller 41, and the paper dust on the surface of the photosensitive drum 5 is captured by the surface of the primary roller 41 (i.e., the outer peripheral face of the roller portion 41B) instead. The transfer residual toner returned to the photosensitive drum 5 is collected by the developing roller 7 (see FIG. 1) located so as to be opposed to the photosensitive drum 5.

In the exemplary embodiment, a secondary cleaning bias is applied to the secondary roller 42 from the power source (not shown) of the body casing 2 via the fourth electrode 28D (see FIGS. 3A and 3B). Therefore, when the paper dust on the surface of the primary roller 41 is opposed to the surface (outer peripheral face) of the secondary roller 42 in accordance with the rotation of the primary roller 41, the paper dust is transferred to the surface of the secondary roller 42 and captured by the secondary roller 42 due to the secondary cleaning bias (more specifically, a bias difference between the primary cleaning bias and secondary cleaning bias).

When the paper dust captured by the secondary roller 42 is opposed to the scraping member 43 in accordance with the rotation of the secondary roller 42, the paper dust is scraped off and dropped off from the surface of the secondary roller 42 by the scraping member 43 and is contained in the storage chamber 47. Here, a gap between the extended portion 49 and the secondary roller 42 is closed by a film-like sealing member 95. Thus, backflow of the paper dust toward the primary roller 41 via the gap can be prevented.

Further, the lower frame 45 and upper frame 46 by which the storage chamber 47 is defined are dividable as described above. Therefore, the storage chamber 47 can be opened and the paper dust stored in the storage chamber 47 can be discarded by detaching the upper frame 46.

Furthermore, the region of the outer peripheral face of the photosensitive drum 5, from which residual electric charges and foreign substances have been removed in the above-described manner, is then opposed to the charger 6 in accordance with the rotation of the photosensitive drum. 5. In this case, when image formation is continued, the region of the outer peripheral face of the photosensitive drum 5, opposed to the charger 6, is electrically charged again by the charger 6, and an electrostatic latent image is formed on this region by the above-described procedure.

As described above, in the second unit 24K of the black photosensitive unit 21K, the transfer residual toner and paper dust on the surface of the photosensitive drum 5 are electrically captured by the primary roller 41. Then, the transfer residual toner captured by the primary roller 41 is electrically returned to the photosensitive drum 5 and thereafter collected by the developing roller 7 (see FIG. 1), while the paper dust captured by the primary roller 41 is electrically captured by the secondary roller 42. Therefore, in a so-called "cleanerless developing method", the efficient removal of the paper dust is enabled in parallel with the collection of the transfer residual toner.

Referring now to FIG. 2B, as described above, the second units 24Y, 24M and 24C (photosensitive units 21Y, 21M and 21C) for colors other than black each include only the primary roller 41 instead of including both of the primary and secondary rollers 41 and 42. In relation thereto, each of the second units 24Y, 24M and 24C does not include the scraping member 43 and the storage chamber 47. Therefore, in each of the second units 24Y, 24M and 24C, the transfer residual toner can be captured from the photosensitive drum 5 and returned to the photosensitive drum 5 by the primary roller 41, but the paper dust cannot be captured from the photosensitive drum 5 and stored (collected) somewhere.

However, referring to FIG. 1, the photosensitive units 21Y, 21M and 21C are located downstream of the photosensitive unit 21K in the conveyance direction of the sheet S as described above. Therefore, paper dust contained in the sheet S is mostly adhered to the outer peripheral face of the photosensitive drum 5 of the photosensitive unit 21K. Hence, the paper dust is hardly adhered to the outer peripheral face of the photosensitive drum 5 of each of the photosensitive units 21Y, 21M and 21C. Consequently, each of the second units 24 (24Y, 24M and 24C) of the photosensitive units 21Y, 21M and 21C does not have to include the function of capturing and collecting paper dust from the photosensitive drum 5.

Further, also in each of the second units 24Y, 24M and 24C, the light guide member 44 removes residual electric charges of the photosensitive drum 5 similarly to the second unit 24K.

As described above, referring to FIGS. 9A and 9B, the primary roller 41 in the photosensitive unit 21 comes into contact with the surface (outer peripheral face) of the photosensitive drum 5, on which a toner image is formed and captures foreign substances on the surface of the photosensitive drum 5. The axial (widthwise) end portions of the primary roller 41 are rotatably supported by the pair of primary bearing members 59 (see also FIG. 5).

In the exemplary embodiment, as shown in FIG. 9B, the pair of coil springs 64 (see also FIG. 5) presses the pair of primary bearing members 59 toward the photosensitive drum 5. Therefore, the primary roller 41 can be directly pressed toward the photosensitive drum 5. Moreover, as shown in FIG. 9A, the pair of guide members 70 guides the pair of primary bearing members 59 in the pressing direction X in which the coil springs 64 press the primary bearing members 59. Therefore, the primary roller 41 can be accurately pressed toward the photosensitive drum 5.

As a result, the primary roller 41 can be stably brought into contact with the photosensitive drum 5.

As shown in FIG. 9B, in the sub-unit 19 of the photosensitive unit 21, the first frame 35 (the unit frame 20 of the tandem photosensitive unit 4 shown in FIG. 1 is also regarded as the first frame 35 in this case) holds the photosensitive drum 5, while the second frame 36 holds the primary roller 41, the pair of primary bearing members 59 and the pair of coil springs 64.

In other words, the primary roller 41, the pair of primary bearing members 59 and the pair of coil springs 64 are unitized in the second frame 36. Therefore, the photosensitive unit 21 can be easily completed by performing a simple operation in which the first and second frames 35 and 36 are combined with each other.

As shown in FIG. 9A, the second frame 36 (see also FIGS. 2A and 2B) is supported by the first frame 35 via the guide members 70. Thus, the guide members 70 not only guide the primary bearing members 59 but also serve to connect the first and second frames 35 and 36 to each other. According thereto, the number of components can be reduced.

As shown in FIGS. 2A and 2B, the light guide member 44 guides the light for removing electric charges at the surface of the photosensitive drum 5, so that the light is guided to the region of the surface of the photosensitive drum 5 (i.e., the lower back side outer peripheral face thereof), which is immediately before coming into contact with the primary roller 41. Thus, electric charges are removed from the region of the surface of the photosensitive drum 5, coming into contact with the primary roller 41. Therefore, the primary roller 41 is capable of smoothly capturing foreign substances on the surface of the photosensitive drum 5 without being influenced by the electric charges at the surface of the photosensitive drum 5.

Furthermore, the number of components can be reduced by providing the light guide member 44 in the second frame 36 because a member for supporting the light guide member 44 does not have to be additionally provided.

The second frame 36 is formed of a light reflecting material (e.g., a white-color material). Therefore, the second frame 36 can helps the light guide member 44 in guiding the light to the surface of the photosensitive drum 5.

As shown in FIG. 5, the primary gear 56 is provided at one axial end portion (left end portion) of the primary roller 41. The primary gear 56 intermeshes the drum gear 68 (see FIGS. 2A and 2B) of the photosensitive drum 5 and rotates the primary roller 41 by a driving force transmitted from the drum gear 68.

Therefore, in the primary roller 41, the position of the left end portion is stabilized. Specifically, the gear teeth of the primary gear 56 provide a helical gear, and the pressure angle direction in the primary gear 56 (i.e., the direction in which the tooth surface of the drum gear 68 presses that of the primary gear 56) is the direction extending outward (leftward) in the widthwise direction. Hence, even if the primary gear 56 has received the driving force, the primary gear 56 is movable only to the left side, but a left wall 35L (see FIG. 7A) of the first frame 35 is located at the left side of the primary gear 56. Therefore, the primary gear 56 can be prevented from being moved to the left side. Consequently, in the primary roller 41, the position of the left end portion can be stabilized.

On the other hand, in the primary roller 41, the position of the other axial end portion (right end portion) side thereof is not stable as the position of the left end portion. Thus, referring to FIG. 10B, in the primary roller 41, the right end portion side might be deviated toward the upstream side in the pressing direction X and might not be able to stably come into contact with the surface of the photosensitive drum 5. Hence, at the right end portion side, the primary roller 41 might not be able to capture foreign substances on the surface of the photosensitive drum 5.

To cope with this, the convex portion 92 is provided at the upstream side of the pressing direction X with respect to the right end portion of the primary roller 41. Incidentally, in the exemplary embodiment, the convex portion 92 is provided at the upstream side in the pressing direction X with respect to each of right and left end portions of the primary roller 41 (see also FIG. 9A).

The convex portion 92 restricts the movement of the right end portion of the primary roller 41 toward the upstream side in the pressing direction X. Thus, the position of the right end portion of the primary roller 41 is stabilized similarly to that of the left end portion side. As a result, the primary roller 41 can be stably brought into contact with the surface of the photosensitive drum 5 at both of the right and left end portion sides. Therefore, the primary roller 41 is capable of reliably capturing foreign substances on the surface of the photosensitive drum 5 across the entire widthwise direction thereof.

As shown in FIG. 2A, the secondary roller 42 comes into contact with the surface of the primary roller 41 (i.e., the outer peripheral face of the roller portion 41B) and captures foreign substances on the surface of the primary roller 41 so as to restore the ability of the primary roller 41 to capture foreign substances on the surface of the photosensitive drum 5. The widthwise end portions of the secondary roller 42 are rotatably supported by the pair of secondary bearing members 60 (see FIG. 5).

Each guide member 70 include the primary and secondary guide parts 71 and 72 (see FIGS. 6A, 6B and 6C).

As shown in FIGS. 9A and 10B, the primary guide part 71 guides the primary bearing member 59 in the pressing direction X. Therefore, the primary roller 41 can be accurately pressed toward the photosensitive drum 5, and the primary roller 41 can be stably brought into contact with the photosensitive drum 5.

The secondary guide part 72 guides the secondary bearing member 60 in the pressing direction X. Therefore, the secondary bearing member 60 is allowed to follow the primary bearing member 59 guided in the pressing direction X by the primary guide part 71, and the secondary roller 42 can maintain the state in which the secondary roller 42 is brought into contact with the surface of the primary roller 41 (see FIG. 2A). As a result, the secondary roller 42 is capable of stably coming into contact with the surface of the primary roller 41 and capturing foreign substances on the surface of the primary roller 41.

As shown in FIG, 1, in the photosensitive unit 21K, the storage chamber 47 contains the foreign substances captured by the secondary roller 42. Therefore, the foreign substances on the surface of the photosensitive drum 5 can be reliably collected. Furthermore, the ability of the secondary roller 42 to capture the foreign substances on the surface of the primary roller 41 can be restored.

The tandem photosensitive unit 4 holds the plurality of photosensitive units 21 (four photosensitive units 21 in the exemplary embodiment) in such a manner that the photosensitive units 21 are aligned in the conveyance direction of the sheet S on which a toner image is to be transferred (i.e., the direction which extends toward the back side along a substantially horizontal direction in the exemplary embodiment, and which will hereinafter be simply referred to as the "conveyance direction"), and the tandem photosensitive unit 4 is detachably attached to/the body casing 2. Therefore, maintenance of each photosensitive unit 21 can be performed by attaching/detaching the tandem photosensitive unit 4 to/from the body casing 2.

In the exemplary embodiment, among the four photosensitive units 21, paper dust of the sheet S is more likely to adhere to the surface of the photosensitive drum 5 in the photosensitive unit 21K located at the most upstream side (most front side) in the conveyance direction, as compared with the photosensitive units 21Y, 21M and 21C located at the downstream side of the conveyance direction with respect to the photosensitive unit 21K. Thus, unlike the primary rollers 41 of the photosensitive units 21Y, 21M and 21C, the primary roller 41 of the photosensitive unit 21K will capture a Large amount of paper dust.

Therefore, the photosensitive unit 21K includes both of the primary and secondary rollers 41 and 42. Thus, in the photosensitive unit 21K, the primary roller 41 is capable of reliably capturing a large amount of paper dust on the surface of the photosensitive drum 5 while the ability of the primary roller 41 to capture the paper dust on the surface of the photosensitive drum 5 is restored by the secondary roller 42.

On the other hand, unlike the primary roller 41 of the photosensitive unit 21K, the primary rollers 41 of the photosensitive units 21Y, 21M and 21C will hardly capture paper dust. This is because the paper dust of the sheet S, which will be adhered to the photosensitive drum 5, is mostly adhered to the photosensitive drum 5 of the photosensitive unit 21K located at the upstream side of the conveyance direction. Accordingly, the photosensitive units 21Y, 21M and 21C each include only the primary roller 41 instead of including both of the primary and secondary rollers 41 and 42.

In other words, in each of the photosensitive units 21K, 21Y, 21M and 21C, settings are made to provide both of the primary and secondary rollers 41 and 42 or provide only the primary roller 41 in an unwasteful manner depending on whether or not paper dust can be adhered to the surface of the photosensitive drum 5.

As a result, the number of components in the tandem photosensitive unit 4 can be reduce, and a size of the tandem photosensitive unit 4 can be reduced.

For example, due to the structure for sheet conveyance, the sheet S on which toner images of all colors have been transferred may go up toward the fixing device 13 at the most downstream side (most rearward position) in the direction of conveyance by the belt 11. In the exemplary embodiment, the photosensitive unit 21C located at the most downstream side in the conveyance direction does not include the secondary roller 42 and the storage chamber 47 (see the photosensitive unit 21K for comparison purposes). Accordingly, a size in the front-back direction thereof can be reduced. Therefore, the photosensitive unit 21C will not inhibit the conveyance of the sheet S that will go up, and unfixed toner of the sheet S can be prevented from being adhered to the photosensitive unit 21C.

(3) Modification to Exemplary Embodiments

In the above-described exemplary embodiment, the guide member 70 (see FIGS. 6A, 6B and 6C) is a component formed separately from the first frame 35 (see FIGS. 7A and 7B), but the guide member 70 may be integrally formed with the first frame 35.

In such a case, the relative positions of the photosensitive drum 5 held by the first frame 35 (in this case, the unit frame 20 of the tandem photosensitive unit 4 shown in FIG, 1 is also regarded as the first frame 35) and the guide member 70 are stabilized. Thus, the guide member 70 is capable of accurately guiding the primary bearing member 59 in the pressing direction X, which is the direction extending toward the photosensitive drum 5 (see FIGS. 9A, 9B, 10A and 10B).

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A photosensitive unit comprising:

a photosensitive member configured to carry a developer image on a surface thereof;

a primary roller configured to contact the surface of the photosensitive member and capture a foreign substance from the surface of the photosensitive member;

a pair of primary bearing members that rotatably supports axial end portions of the primary roller;

a pair of pressing members configured to press the pair of primary bearing members toward the photosensitive member; and a pair of guide members configured to guide the pair of primary bearing members in a pressing direction in which the pair of pressing members press the pair of primary bearing members, wherein each of the pair of guide members comprises a primary guide part, the primary guide part comprising a primary concave portion having a substantially elliptical shape extending in the pressing direction, and wherein the primary bearing member is configured to be freely fit to the primary concave portion to be slidable in the pressing direction.

2. The photosensitive unit according to claim 1, further comprising:

a first frame configured to hold the photosensitive member; and a second frame configured to hold the primary roller, the pair of primary bearing members and the pair of pressing members.

3. The photosensitive unit according to claim 2, wherein the pair of guide members is configured to be engaged with and fixed to the first frame.

4. The photosensitive unit according to claim 2, wherein the first frame supports the second frame via the pair of guide members.

5. The photosensitive unit according to claim 2, wherein the first frame integrally comprises a first holder, a second holder and a convex portion between the first holder and the second holder.

6. The photosensitive unit according to claim 5, wherein the first holder comprises a first claw, wherein the second holder comprises a second claw, and wherein each of the pair of guide members comprises a first engagement portion and a second engagement portion configured to engage the first claw and the second claw, respectively.

7. The photosensitive unit according to claim 5, wherein a cut-out is formed to the primary guide part at an upstream side in the pressing direction, and wherein the convex portion is fit to the cut-out and is configured to restrict the movement of the primary roller toward the upstream side in the pressing direction.

8. The photosensitive unit according to claim 1, wherein the photosensitive member comprises a first gear, wherein the primary roller comprises a second gear at first axial end portion thereof, wherein the second gear intermeshes the first gear so as to rotate the primary roller by a driving force transmitted from the first gear, and wherein the photosensitive unit further comprises:

a restricting part, which is provided at an upstream side of the pressing direction with respect to a second axial end portion of the primary roller, and which is configured to restrict movement of the second axial end portion of the primary roller toward the upstream side of the pressing direction.

9. The photosensitive unit according to claim 1, further comprising:

a secondary roller configured to contact a surface of the primary roller to capture a foreign substance from the surface of the primary roller; and a pair of secondary bearing members that rotatably support axial end portions of the secondary roller, wherein each of the pair of guide members further comprises a secondary guide part configured to guide the secondary bearing member in the pressing direction, wherein the secondary guide part comprises a secondary concave portion having a substantially elliptical shape extending in the pressing direction, and wherein the secondary bearing member is configured to be freely fit to the secondary concave portion to be slidable in the pressing direction.

10. The photosensitive unit according to claim 9, further comprising:

a foreign substance container configured to contain the foreign substance captured by the secondary roller.

11. The photosensitive unit according to claim 1, further comprising:

a charger configured to electrically charge the surface of the photosensitive drum.

12. The photosensitive unit according to claim 1, wherein the primary guide part further comprises an insertion hole having a substantially elliptical shape, which is smaller than that of the concave portion, and which extends in the pressing direction.

13. A photosensitive unit comprising:

a photosensitive member configured to carry a developer image on a surface thereof;

a primary roller configured to contact the surface of the photosensitive member, and capture a foreign substance from the surface of the photosensitive member;

a pair of primary bearing members that rotatably supports axial end portions of the primary roller;

a pair of pressing members configured to press the pair of primary bearing members toward the photosensitive member;

a pair of guide members configured to guide the pair of primary bearing members in a pressing direction in which the pair of pressing members press the pair of primary bearing members;

a first frame configured to hold the photosensitive member; and a second frame configured to hold the primary roller, the pair of primary bearing members and the pair of pressing members, wherein the second frame comprises a light guide member configured to guide light to the surface of the photosensitive member for removing an electronic charge at the surface of the photosensitive member, and wherein the light guide member is configured to guide the light to the surface of the photosensitive member at a region upstream of a contact point between the primary roller and the photosensitive member in a rotation direction of the photosensitive member.

14. The photosensitive unit according to claim 13, wherein the second frame comprises a light reflecting material.

15. The photosensitive unit according to claim 13, further comprising:

a first frame configured to hold the photosensitive member; and a second frame configured to hold the primary roller, the pair of primary bearing members and the pair of pressing members.

16. The photosensitive unit according to claim 15, wherein the pair of guide members is configured to be engaged with and fixed to the first frame.

17. The photosensitive unit according to claim 15, wherein the first frame supports the second frame via the pair of guide members.

18. A tandem photosensitive unit that is detachably attachable to an image forming apparatus body, the tandem photosensitive unit comprising:

a plurality of photosensitive units aligned in a conveyance direction of a recording medium, wherein a first photosensitive unit selected from the plurality of photosensitive units is located at a most upstream side in the conveyance direction, wherein the first photosensitive unit comprises:

a first photosensitive member configured to carry a developer image on a surface thereof;

a first primary roller configured to contact the surface of the photosensitive member and capture a foreign substance from the surface of the first photosensitive member;

a first pair of primary bearing members that rotatably support axial end portions of the first primary roller;

a first pair of pressing members configured to press the first pair of primary bearing members toward the first photosensitive member;

a first pair of guide members configured to guide the first pair of primary bearing members in a pressing direction in which the first pair of pressing members press the first pair of primary bearing members;

a first secondary roller configured to contact a surface of the first primary roller to capture a foreign substance from the surface of the first primary roller; and a first pair of secondary bearing members that rotatably support axial end portions of the first secondary roller, wherein each of the first pair of guide members comprises:

a primary guide part configured to guide the first primary bearing member in the pressing direction; and a secondary guide part configured to guide the secondary bearing member in the pressing direction, and wherein a second photosensitive unit selected from the plurality of photosensitive units is located at a downstream side of the conveyance direction with respect to the first photosensitive unit, wherein the second photosensitive unit comprises:

a second photosensitive member configured to carry a developer image on a surface thereof;

a second primary roller configured to contact the surface of the second photosensitive member and capture a foreign substance from the surface of the second photosensitive member;

a pair of second primary bearing members that rotatably support axial end portions of the second primary roller;

a second pair of pressing members configured to press the second pair of primary bearing members toward the second photosensitive member; and a second pair of guide members configured to guide the second pair of primary bearing members in a pressing direction in which the second pair of pressing members press the second pair of primary bearing members, wherein the second photosensitive unit does not contain a secondary roller.

19. The photosensitive unit according to claim 18, wherein the first photosensitive unit further comprises:

a first frame configured to hold the first photosensitive member; and a second frame configured to hold the first primary roller, the first pair of primary bearing members and the first pair of pressing members, and wherein the second photosensitive unit further comprises:

a first frame configured to hold the second photosensitive member; and a second frame configured to hold the second primary roller, the second pair of primary bearing members and the second pair of pressing members.

20. The photosensitive unit according to claim 19, wherein the first pair of guide members is configured to be engaged with and fixed to the first frame of the first photosensitive unit, and wherein the second pair of guide members is configured to be engaged with and fixed to the first frame of the second photosensitive unit.

21. The photosensitive unit according to claim 19, wherein the first frame of the first photosensitive unit supports the second frame via the first pair of guide members, and wherein the first frame of the second photosensitive unit supports the second frame via the second pair of guide members.

22. The photosensitive unit according to claim 18, wherein, in the first photosensitive unit, the first photosensitive member comprises a first gear, the first primary roller comprises a second gear at a first axial end portion thereof, and the second gear intermeshes with the first gear so as to rotate the first primary roller by a driving force transmitted from the first gear, wherein the first photosensitive unit further comprises:

a first restricting part, which is provided at an upstream side in the pressing direction with respect to a second axial end portion of the first primary roller, and which is configured to restrict movement of the second axial end portion of the first primary roller toward the upstream side in the pressing direction, wherein in the second photosensitive unit, the second photosensitive member comprises a first gear, the second primary roller comprises a second gear at a first axial end portion thereof, and the second gear intermeshes with the first gear so as to rotate the second primary roller by a driving force transmitted from the first gear, and wherein the second photosensitive unit further comprises:

a second restricting part, which is provided at an upstream side in the pressing direction with respect to a second axial end portion of the second primary roller, and which is configured to restrict movement of the second axial end portion of the second primary roller toward the upstream side in the pressing direction.

23. The photosensitive unit according to claim 18, wherein the first photosensitive unit further comprises:

a foreign substance container configured to contain the foreign substance captured by the first secondary roller.

* * * * *